US007866274B2

(12) United States Patent
Edelson et al.

(10) Patent No.: US 7,866,274 B2
(45) Date of Patent: Jan. 11, 2011

(54) PILE TRANSLATING AND LAUNCHING SYSTEM AND METHOD

(75) Inventors: David N. Edelson, Wallis, TX (US); Michael Perceval, Houston, TX (US); Dean Kypke, Houston, TX (US)

(73) Assignee: Technip France, Courbevoie (FR)

( * ) Notice: Subject to any disclaimer, the term of this patent is extended or adjusted under 35 U.S.C. 154(b) by 351 days.

(21) Appl. No.: 12/187,293

(22) Filed: Aug. 6, 2008

(65) Prior Publication Data

US 2009/0245977 A1 Oct. 1, 2009

Related U.S. Application Data

(60) Provisional application No. 61/039,462, filed on Mar. 26, 2008.

(51) Int. Cl.
*B65D 88/78* (2006.01)

(52) U.S. Cl. ..... 114/256

(58) Field of Classification Search ..... 114/124, 114/210, 264–269, 382, 256
See application file for complete search history.

(56) References Cited

U.S. PATENT DOCUMENTS

| | | | | |
|---|---|---|---|---|
| 3,993,011 | A | 11/1976 | Garland | |
| 4,345,536 | A * | 8/1982 | Gregg | 114/124 |
| 6,676,334 | B2 * | 1/2004 | Horton, III | 405/205 |
| 2007/0017680 | A1 | 1/2007 | Wilde et al. | |

FOREIGN PATENT DOCUMENTS

| | | |
|---|---|---|
| BR | PI 0306058-6 A | 8/2005 |
| EP | 1036886 | 9/2000 |
| FR | 2792990 | 11/2000 |
| FR | 2865520 | 7/2005 |
| GB | 2431189 | 4/2007 |

OTHER PUBLICATIONS

Harald Geiger, International Search Report for International Patent Application No. PCT/US2009/033090, dated May 13, 2009, European Patent Office, Germany.
Harald Geiger, Written Opinion for International Patent Application No. PCT/US2009/033090, dated May 13, 2009, European Patent Office, Germany.

* cited by examiner

*Primary Examiner*—Daniel V Venne
(74) *Attorney, Agent, or Firm*—Lock Lord Bissell & Liddell LLP

(57) ABSTRACT

The disclosure provides an efficient system to obtain a pile from a storage location on a vessel and shift the pile across the vessel without significant rotation of the pile. The pile can be transferred into an assembly that can lower the pile and launch the pile. The disclosure provides a method of translating and launching a pile for a marine application, comprising: storing at least a first pile on a rack located on a vessel; transporting the pile to an installation site; lifting the pile from the rack with a cart; supporting the pile on the cart; shifting the cart and the pile to a launch arm assembly; transferring the pile from the cart to a first portion of the launch arm assembly adjacent a side of the vessel; lowering the first portion with the pile; and releasing the pile from the first portion into a marine environment.

12 Claims, 19 Drawing Sheets

PILE TRANSLATING AND LAUNCHING SYSTEM AND METHOD

CROSS REFERENCE TO RELATED APPLICATIONS

This application claims the benefit of U.S. Provisional Application No. 61/039,462, filed Mar. 26, 2008.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO APPENDIX

Not applicable.

BACKGROUND

1. Field of the Invention

The disclosure relates to pile translating and launching systems, and particularly for pile translating and launching systems for securing marine structures, such as floating platforms, drilling or production risers, vessels, and the like.

2. Description of Related Art

Often marine structures used in offshore petroleum industry are moored to a pile that is anchored to a sea floor. The pile is generally a tubular element that is installed into seabed deposits that form the sea floor. The size of the pile can vary and an exemplary size is about 35-55 meters long and about 2-3 meters in diameter. The pile includes a top, sometimes known as a "pile cap," attached to tubular sides, and is open at the bottom. A valve can be used to help set the pile. The pile further includes a padeye. The padeye generally is a reinforced section that is attached to the sidewall of the pile along the middle of its length and extends outward from the pile. The padeye is used to attach an anchor line, chain, or other coupling member to an offshore platform or other structure (not shown) that may need mooring or otherwise securing.

Typically, a load of piles is floated to the site to be offloaded into the sea and installed into the sea floor. Some prior systems lift the pile from an end with a hoist, such as a crane, and maneuver the pile to the side of a ship, barge, or other vessel to lower the pile into the sea. This process is known to be dangerous due to the lifting.

Another known system disclosed in U.S. Publ. No. 20070017680, allows the pile to roll down an inclined rail to a stop near the side of a vessel. The stop can be rotated to allow the pile to roll off the vessel and into the sea. The system requires the pile to roll along a surface to move to the side of the vessel.

However, some piles are not intended to be rolled and could be damaged from such rolling. For example, some cylinders, shafts, chains, and other equipment can be mounted along a length of the pile that inhibits rolling of the pile. Thus, the system in U.S. Publ. No. 20070017680 would be unsuitable for launching such a pile.

Therefore, there remains a need to provide an improved system and method that can launch a pile into the sea or other marine environment, such as the ocean or other body of water, that solves the limitations of the prior art.

BRIEF SUMMARY

The disclosure provides an efficient system to obtain a pile from a storage location on a vessel and shift the pile across the vessel without significant rotation of the pile. The pile can be transferred into an assembly that can lower the pile and launch the pile. The disclosure provides a method of translating and launching a pile for a marine application, comprising: storing at least a first pile on a rack located on a vessel; transporting the pile to an installation site; lifting the pile from the rack with a cart; supporting the pile on the cart; shifting the cart and the pile to a launch arm assembly; transferring the pile from the cart to a first portion of the launch arm assembly adjacent a side of the vessel; lowering the first portion with the pile; and releasing the pile from the first portion into a marine environment.

The disclosure also provides a system for translating and launching a pile for a marine application, comprising: a vessel; at least one rack coupled to the vessel; a first pile disposed on the rack; at least one cart disposed on a travel path lateral to a length of the pile; a first motive force means coupled to the cart and adapted to move the cart along the lateral travel path; a second motive force means coupled to the cart and adapted to raise and lower the cart between a low first elevation and a high second elevation, the low first elevation being lower than an elevation of the pile when disposed on the rack to provide clearance for the cart as the cart moves laterally under the pile, and the high second elevation being higher than a height of the rack to provide clearance for the pile as the cart laterally moves the pile over the rack; a first portion of a launch arm assembly rotatably coupled in proximity to a side of the vessel and adapted to receive the pile during a transfer from the cart; and a third motive force means adapted to cause rotation of the first portion of the launch arm assembly between a first position adapted to receive the pile from the cart and a second position adapted to allow the pile to be launched from the first portion of the launch arm assembly.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "Upper," "lower," "down," "up," "side," and the like are used in the written description for clarity in specific reference to the Figures and are not intended to limit the scope of the invention or the appended claims.

Figure 1:
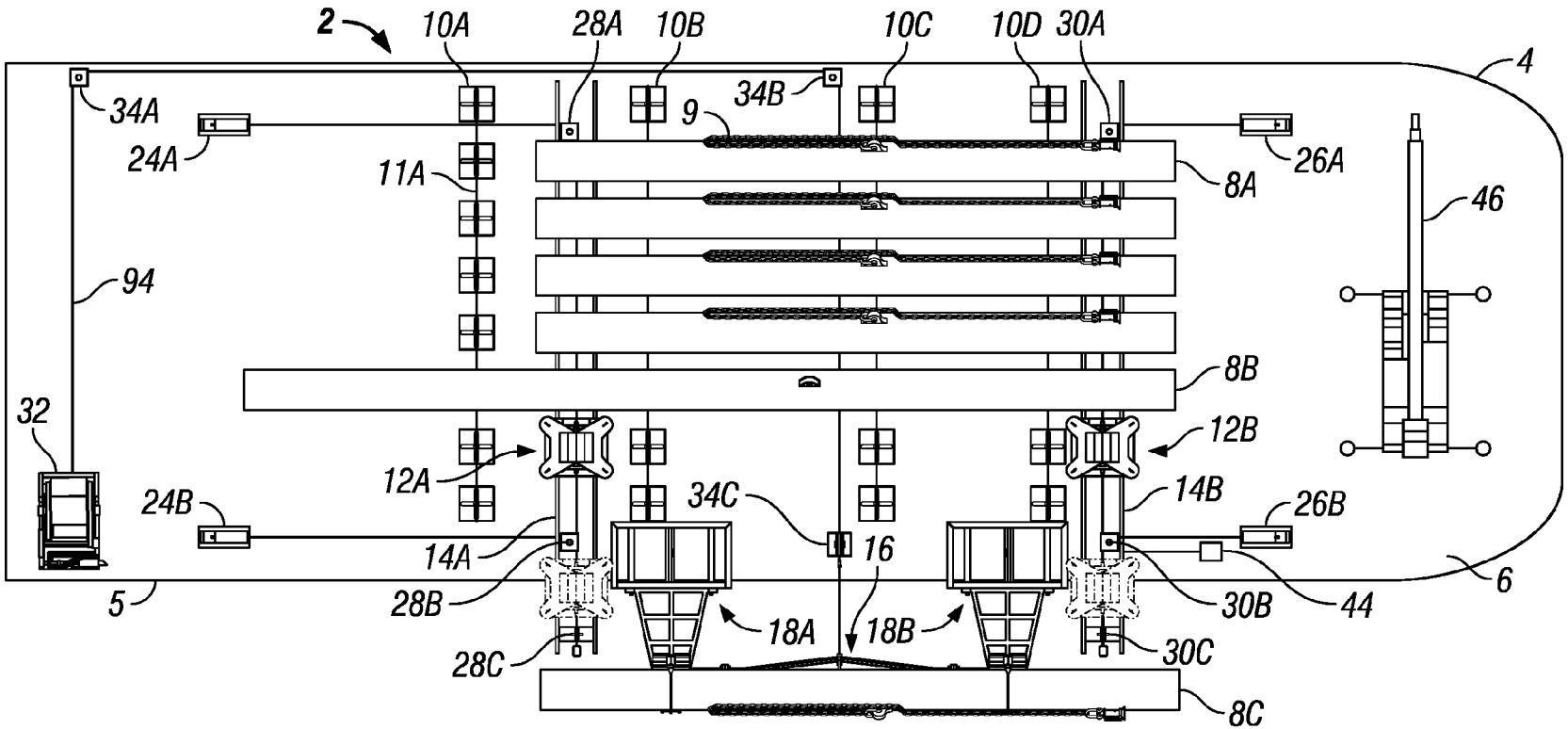
FIG. 1 is a schematic top view of an exemplary embodiment of the pile translating and launching system.

FIG. 1 is a schematic top view of an exemplary embodiment of the pile translating and launching system. The system 2 generally includes a vessel 4 for transporting the piles to an installation site. The vessel 4 can be any variety of a vessel such as ship, barge, or other floating vessel. The vessel 4 generally includes a side 5 that is broadly defined herein and can be a surface that is exposed to the marine environment and can be disposed around the port, starboard, bow, and stern, or internal to the vessel perimeter such as an opening through the vessel that is exposed to the marine environment. Further, the vessel generally includes a deck 6. The deck 6 generally is where the various mechanisms, racks, piles, carts, and other devices are stored or actuated. The vessel 4 can carry at least one and generally a plurality of piles. The piles, depending on the installation are generally between 33 meters long to 55 meters long and 2 to 3 meters in diameter. The vessel 4 can carry various lengths of piles, such as a shorter pile 8A and longer pile 8B, generally referred to pile 8 herein. As described herein, several elements are shown in a plurality of positions and quantities. For example, there are a plurality of supports, carts, rails, frames, and so forth. Some elements are labeled by an element number followed by an alphabetic indication to describe that element from other like elements. For example, a first pile is labeled 8A, a second pile is labeled 8B, a third pile is labeled 8C, and so forth. At times, the descriptions simply refer to the generic number, such as pile 8, even if individual elements are labeled as pile 8A, 8B, or 8C. A padeye connection assembly 9 is generally preinstalled on the pile, such as piles 8A, and 8C, although it is not shown on pile 8B for simplicity. As discussed above, a difficulty in simply rolling the pile 8 down an incline is that the surface is asymmetrical and does not easily roll, if at all. Thus, a different system is needed, as is described herein.

In transporting the piles to the site, a series of supports are aligned at different lengths along the piles. For example, the supports include a support 10A that is generally spaced for the longer piles such as pile 8B, in conjunction with supports 10B, 10C, 10D. The supports themselves are generally coupled to a rack 11, described in more detail below. The rack 11 allows the piles to be spaced at preset distances from each other generally at a fixed elevation for delivery to the installation site. Carts 12A, 12B can be used to translate the piles from a storage position to a launching position, as will be described in more detail below. The cart 12A has a travel path that is generally lateral to the length of the pile, although other angles can be used. The cart 12B is spaced apart from the cart 12A to assist in supporting the pile and also has a travel path that is generally lateral to the pile and parallel to the travel path of the cart 12A. To assist the carts in their travel path, a rail 14 can be used. For example, a rail 14A can be disposed along the travel path of the cart 12A, so that the cart moves laterally across the deck 6 as the cart moves the piles from the storage position to the launching position. Similarly, a rail 14B can be used in conjunction with the cart 12B to assist the cart 12B as it moves laterally along its travel path. The carts 12A, 12B deliver the pile 8 to a launch arm assembly 16. The launch arm assembly 16 is generally disposed adjacent a side 5 of the vessel 4. Launch frames 18A, 18B support the launch arm assembly on the vessel 4. At least a portion of the launch frame 18 is rotatably coupled to the side 5, so that as a pile 8 is loaded from the cart 12 onto the launch arm assembly 16, the pile can rotate and therefore translate outwardly from the side 5 into a launching position.

The various movements of the cart, launching arm, and other associated equipment can be actuated by various motive force means, such as winches, hydraulic power packs and associated hydraulic cylinders, electrical motors, gears and sprockets, and other items providing motive forces. For example, a winch 24A can be coupled to a winch cable and guided through a sheave 28A to the cart 12A. The winch 24A can pull the cart 12A along the rail 14A toward the port side, that is, upward from the orientation of the vessel 4 in FIG. 1. Similarly, a winch 24B can be coupled to a winch cable that can be routed through a sheave 28B and around sheave 28C and looped back to the cart 12A to pull the cart 12A toward the launch arm assembly, that is, starboard in the exemplary embodiment and downward in the orientation shown in FIG. 1. The extra sheave 28C allows the cart 12A to be pulled toward the launch arm assembly along the rail 14A to a position that extends beyond the side 5 of the vessel 4 for the purposes explained herein. The cart 12B has a similar system and arrangement with the winches. For example, a winch 26A can be coupled to a winch cable that is directed around sheave 30A and coupled to the cart 12B to pull the cart 12B toward the port side of the vessel 4, as shown on the orientation of FIG. 1. Likewise, a winch 26B can be coupled to a winch cable that is routed around a sheave 30B to a starboard direction around sheave 30C and back to the starboard side of the cart 12B to pull the cart 12B toward the starboard side.

Another motive force means can be provided for the launch arm assembly. For example, a winch 32 can be used to move the launch arm assembly. The winch 32 can be coupled to a winch cable that can be directed around a sheave 34A, around a sheave 34B, through a sheave 34C, and coupled to the launch arm assembly. In at least one embodiment, the launch arm assembly is positioned, so that its center of gravity is biased outwardly from the side 5 of the vessel 4. Therefore, the winch cable of the winch 32 would provide a tensile force to the launch arm assembly to restrict the launch arm assembly from rotating outwardly away from the side 5 of the vessel 4. Naturally, other arrangements could be made, such as being biased toward the side and the motive force means, such as the winch 32, providing an outward force through the use of sheaves, hydraulics, and other mechanisms known to those with ordinary skill in the art, given the disclosure contained herein.

A launch arm release station 44 can also be positioned on the vessel 4. Generally, the launch arm release station 44 can be manually activated, so that when the launch arm assembly 16 is in position for launching the pile 8, the launch arm release station can be activated to release a restraining member on the pile to launch the pile into a marine environment 110.

Further, the vessel 4 can include a crane 46 generally disposed on the deck 6. The crane 46 can help position various members of the working deck as may be appropriate.

Figure 2A:
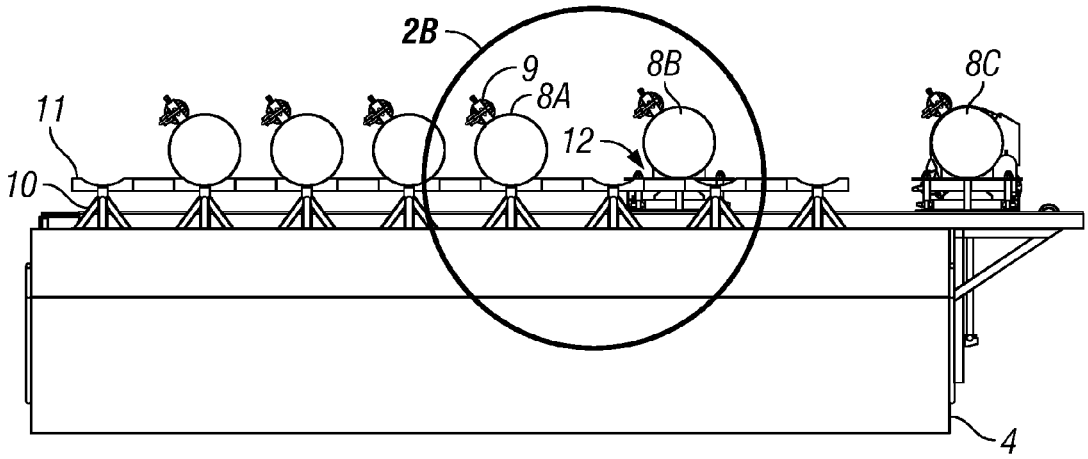
FIG. 2A is a schematic end view of the vessel 4 showing the support, pile, rack, and a cart shown thereunder.
Figure 2B:
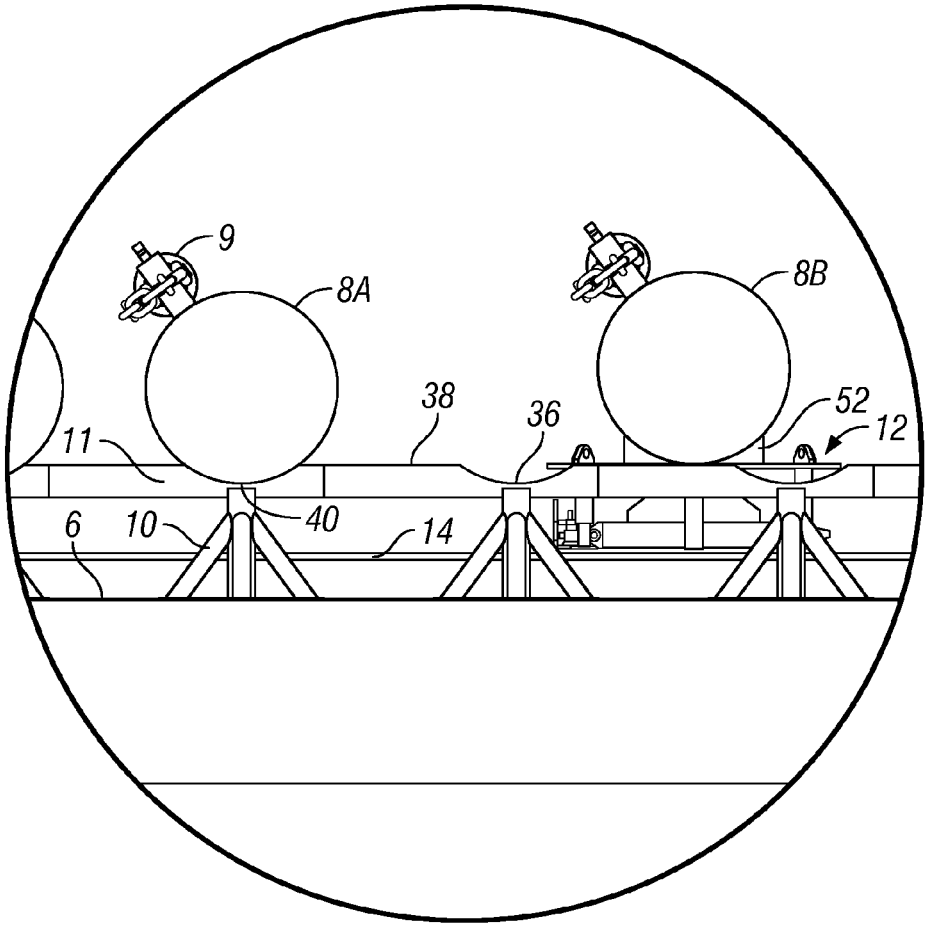
FIG. 2B is a schematic enlarged view of the support, rack, pile, and cart shown in FIG. 2A.

FIG. 2A is a schematic end view of the vessel 4 showing the support, pile, rack, and a cart shown thereunder. FIG. 2B is a schematic enlarged view of the support, rack, pile, and cart shown in FIG. 2A. The drawings will be described in conjunction with each other. In at least one embodiment, the piles, such as piles 8A, 8B, 8C, are transported on the vessel 4 to an installation site with the piles stored on one or more supports 10 coupled to one or more racks 11. The rack 11 can be formed with a rack slot 36 that generally is an arcuate slot shaped to fit an exterior perimeter of the pile 8. When the pile 8 is disposed in the rack slot 36, a side of the pile establishes a lower elevation 40 of the pile that is a certain distance from some fixed surface, such as the deck 6 or the rail 14. Further, the pile 8 generally has a padeye connection assembly 9 coupled thereto that generally restricts the ability of the pile 8 to rotate a full turn. Thus, rolling the pile generally is an unacceptable solution to moving the pile laterally from a storage position to the launch arm assembly described above. A solution offered by the present disclosure uses the cart 12 in a lowered position to travel beneath the pile 8, that is, below the pile lower elevation 40. When positioned under a pile, the cart 12 is activated to raise the pile to a higher elevation, so that it contacts the pile 8. In at least one embodiment, a cart cradle 52 of the cart 12 is used to engage the pile 8. The cart 12 using the cart cradle 52 continues raising the pile 8 until the pile lower elevation 40 is raised higher than the top 38 of the rack 11 to provide clearance over the top 38. The pile 8 can then be translated along the rail 14 toward the launch arm assembly 16, shown in FIG. 1.

Figure 3A:
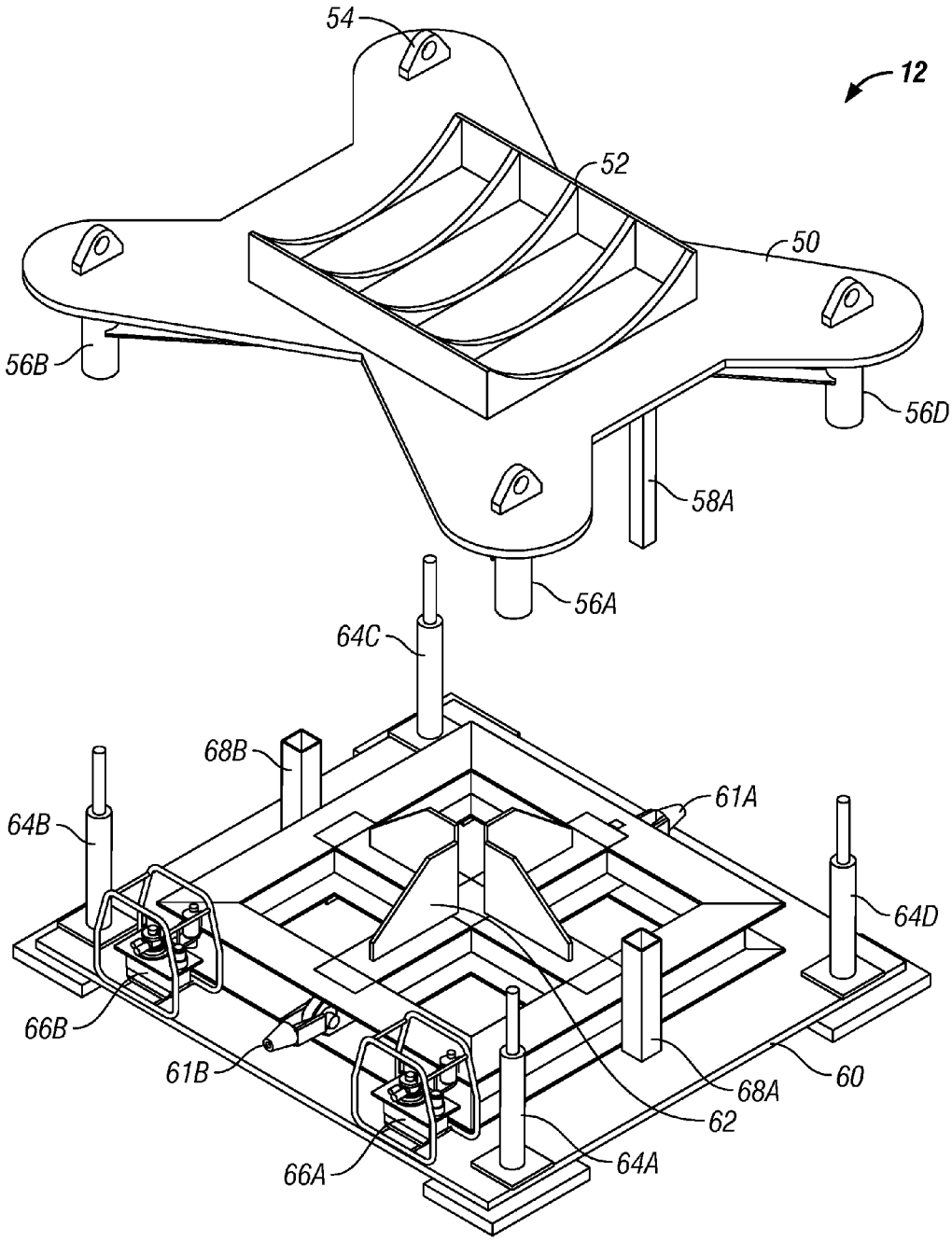
FIG. 3A is a schematic exploded view of the cart.
Figure 3B:
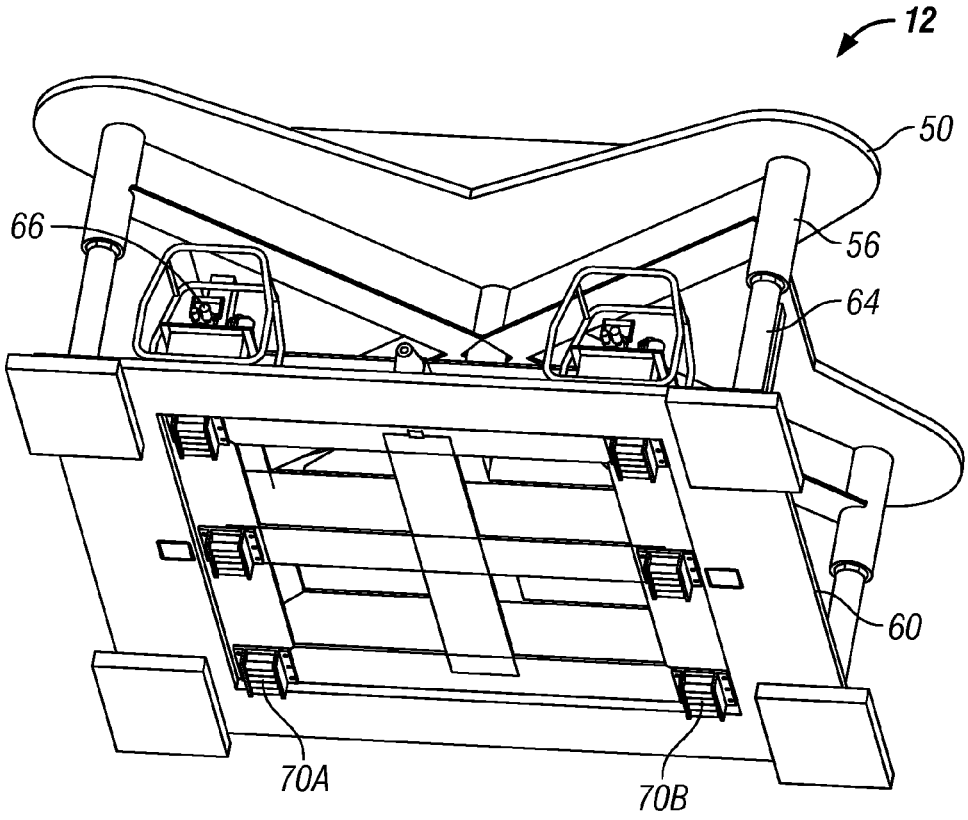
FIG. 3B is a schematic bottom perspective view of the cart shown in FIG. 3A.
Figure 3C:
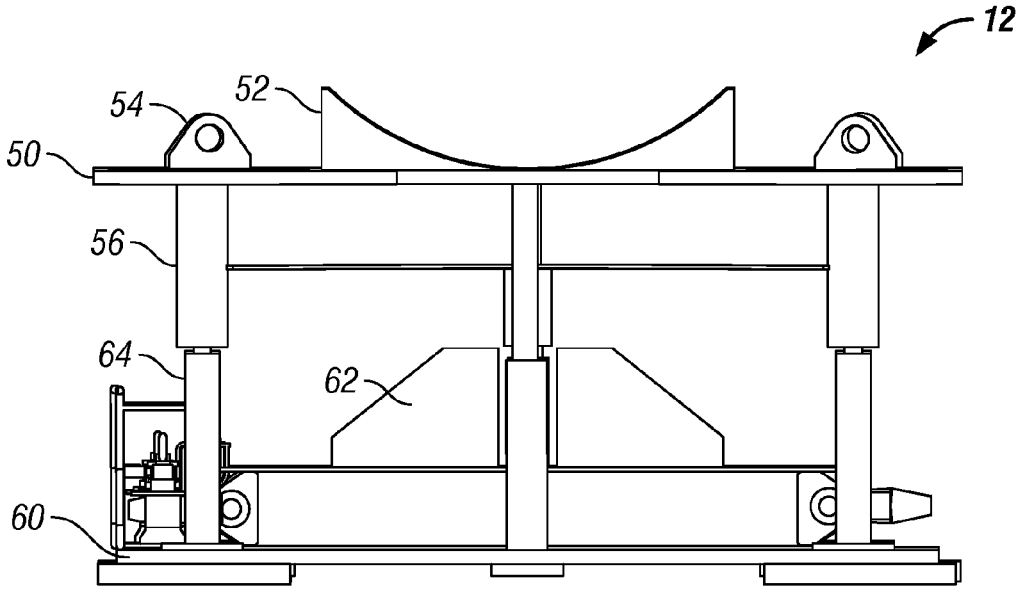
FIG. 3C is a schematic side view of the cart.

FIG. 3A is a schematic exploded view of the cart. FIG. 3B is a schematic bottom perspective view of the cart shown in FIG. 3A. FIG. 3C is a schematic side view of the cart. These figures will be described in conjunction with each other. The cart 12 generally includes a cart upper portion 50. The cart upper portion 50 is the portion that can be moved up and down at various elevations to raise and lower the pile 8, as appropriate. The cart upper portion 50 generally includes a cart cradle 52. The cart cradle 52 in at least one embodiment will generally have an arcuate shape, such that it fits an outer perimeter of the pile 8 and restricts the rolling and translating movement of the pile 8 relative to the cart 12. The cart upper portion 50 further can include one or more lift couplings 54. The lift couplings are suitable for handling and assembly of the cart. The cart upper portion 50 of the cart 12 can include in at least one embodiment a plurality of receivers 56A, 56B, 56D, with a fourth receiver not being shown in the perspective view of FIG. 3A. More or less receivers can be used and the configuration is exemplary. Further, the cart upper portion 50 can include a centralizer 58A disposed between the receivers 56A, 56B.

The cart 12 can further include a cart lower portion 60. The cart lower portion 60 is adapted to interface with and receivably mount the cart upper portion 50. For example, the cart lower portion 60 can include a cart upper portion support 62. The cart upper portion support 62 generally forms a lowest stop for travel of the cart upper portion 50 relative to the cart lower portion 60. Further, the cart lower portion 60 can include one or more hydraulic cylinders 64A, 64B, 64C, 64D. The hydraulic cylinders are adapted to engage the receivers 56A, 56B, 56D, and the fourth one not shown from the prospective view. One or more hydraulic power units 66 can also be coupled to the cart 12 to provide fluid to the hydraulic cylinders for activation thereof Collectively, the hydraulic power units and associated hydraulic cylinders provide a motive force to the cart 12 for raising and lowering the cart upper portion 50. Further, the cart lower portion 60 can include one or more centralizer receivers 68A, 68B. The centralizer receivers 68A, 68B are adapted to receive the centralizer 58A on the cart upper portion 50, and an associated centralizer to the back of the cart upper portion 50 that is not shown in the orientation of FIG. 3A. The engagement of the centralizer 58 with the centralizer receiver 68 assists the cart upper portion 50 to remain positioned horizontally relative to the cart lower portion 60. The cart lower portion 60 further can include one or more rollers, 70A, 70B, shown in FIG. 3B. Generally, the rollers are arranged in rows, such as two rows. The two rows of rollers can be adapted to fit the rail 14, shown in FIG. 1. As merely illustrative and without limitation, the rollers can be Hillman rollers with an Accu-Roll guided system. Other rollers, wheels, and other elements can be used to assist the cart 12 in translating across the deck 6 of the vessel 4.

Figure 4A:
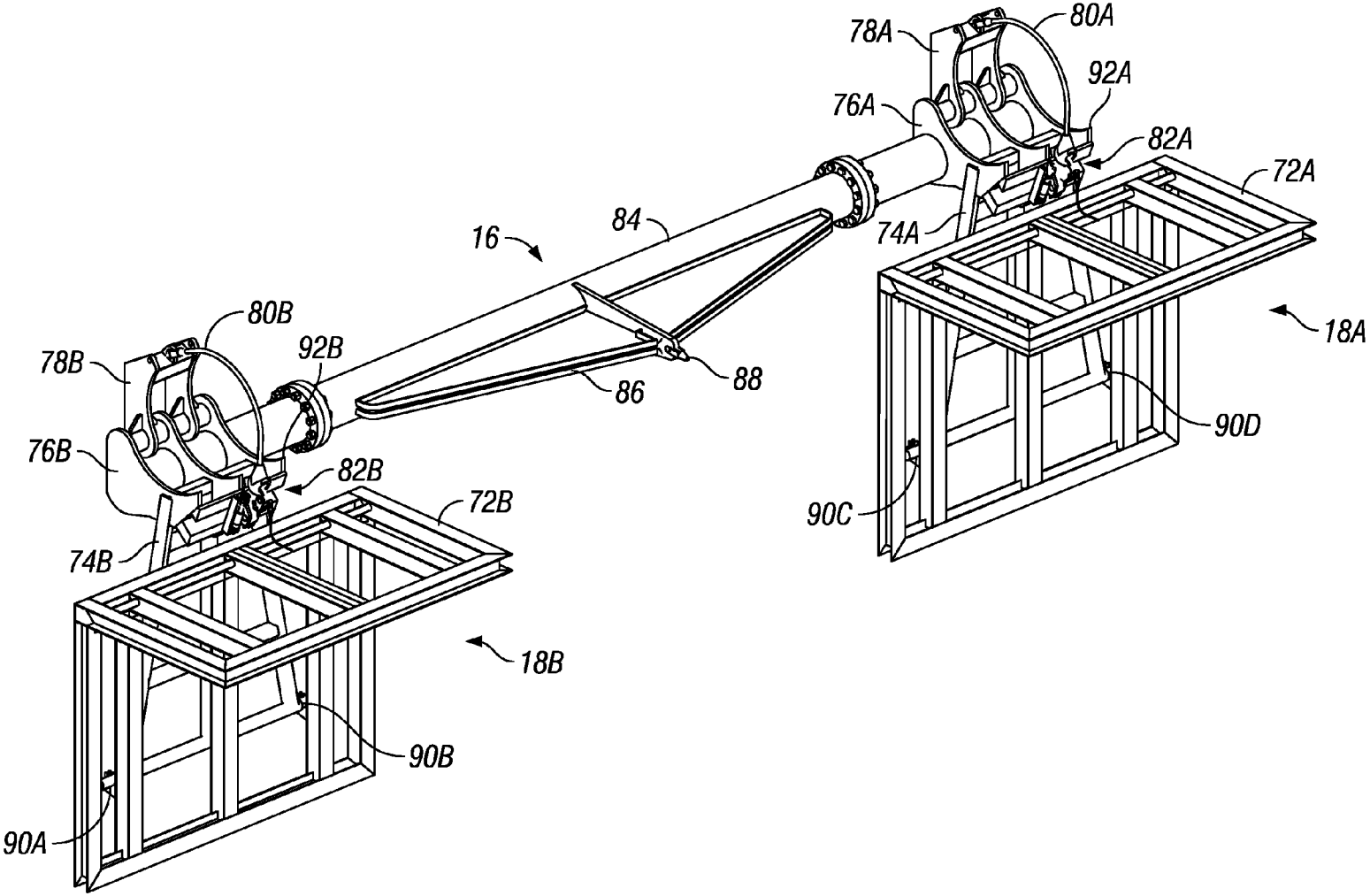
FIG. 4A is a schematic perspective view of the launch arm assembly 16.
Figure 4B:
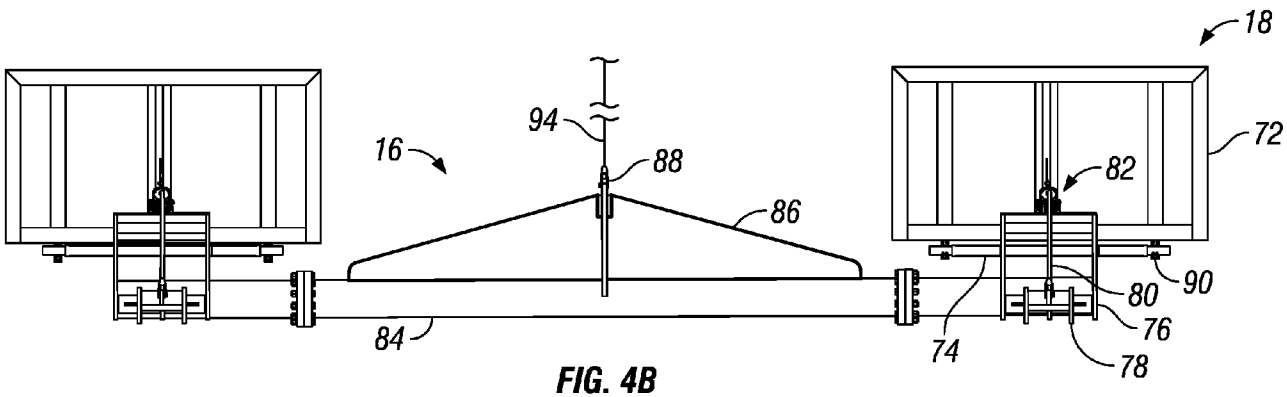
FIG. 4B is a schematic top view of the launch arm assembly.
Figure 4C:
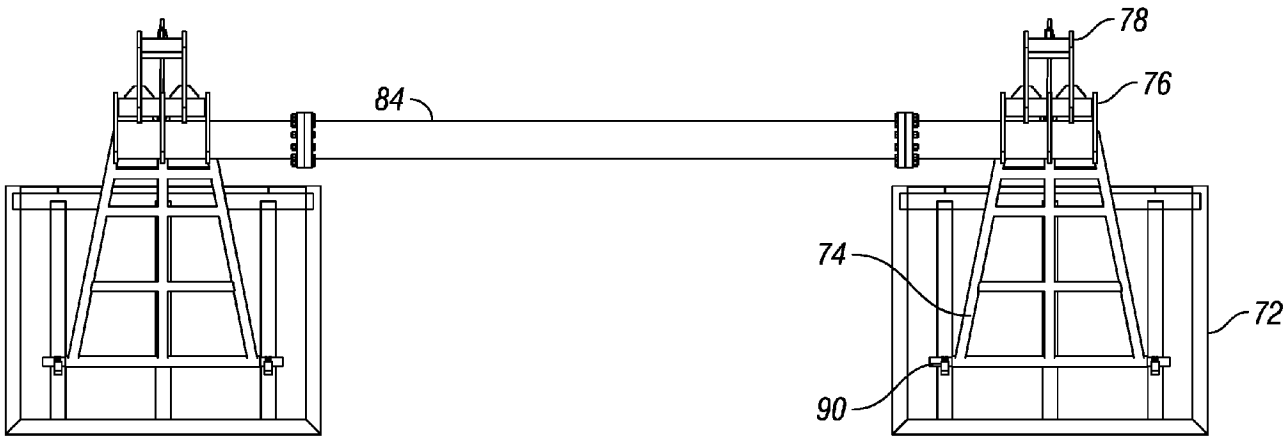
FIG. 4C is a schematic front view of the launch arm assembly.

FIG. 4A is a schematic perspective view of the launch arm assembly. FIG. 4B is a schematic top view of the launch arm assembly. FIG. 4C is a schematic front view of the launch arm assembly. The figures will be described in conjunction with each other. A first portion of the launch arm assembly 16 can include one or more members, described herein, that are rotatably coupled to the vessel 4 to assist in launching the pile from the vessel. One or more other portions of the launch arm assembly can remain fixedly coupled to the vessel to provide support for the rotatable portion or portions. The launch arm assembly 16 can include a launch frame 18. The launch frame 18 is shown in at least one embodiment as a first launch frame 18A, and a second launch frame 18B. Each launch frame 18 can be mounted to a side of the vessel 4 that provide access to the marine environment 110, to launch the pile disposed thereon. In at least one embodiment, the launch frame 18A can include a rotatable frame 74A coupled to a support frame 72 at one or more rotatable joints 90C, 90D. Similarly, the launch frame 18B can include a support frame 72B coupled to a rotatable frame 74B at one or more rotatable joints 90A, 90B. In general, the support frame 72 remains fixedly attached to the vessel 4, while the rotatable frames 74A, 74B can rotate outwardly from the vessel 4 and in the process lower the launch arm assembly 16 toward the marine environment.

Launch arm cradles 76A, 76B are coupled to the rotatable frames 74A, 74B, respectively. The launch arm cradles 76A, 76B generally include an arcuate portion sized to fit an outer perimeter of the pile. The launch arm cradles 76A, 76B generally have launch arm cradle ends 92A, 92B, which are lower in elevation than the pile as the pile is delivered to the launch arm cradles. The launch arm cradles 76A, 76B further include release arms 78A, 78B, respectively. The release arms 78A, 78B are rotatably coupled to the launch arm cradles 76A, 76B and can be rotated outwardly to allow the pile to be launched from the launch arm assembly 16. To temporarily maintain the pile in engagement with the launch arm cradles 76A, 76B, one or more tie down cables 80A, 80B can be removably coupled to the launch arm cradles 76A, 76B and more specifically to the release arms 78A, 78B. The tie down cables 80A, 80B are coupled to one or more latch mechanisms 82A, 82B. The latch mechanisms 82A, 82B can be released by activating a cable or other device to release the tie down cables 80A, 80B so that the release arms 78A, 78B can be lowered and thus release the pile from the launch arm cradles.

The launch arm cradles 76A, 76B are coupled together by a spreader beam 84. The spreader beam 84 can be coupled through flange connections, threading connections, welding, or any number of other coupling techniques. A center support 86 can be used to provide rigidity to the spreader beam 84. A launch arm coupling 88 can be provided on the center support 86. The launch arm coupling 88 can be coupled to a winch cable 94 that is ultimately coupled to the winch 32, described in FIG. 1 for controlling the movement of the launch arm assembly 16.

Figure 5A:
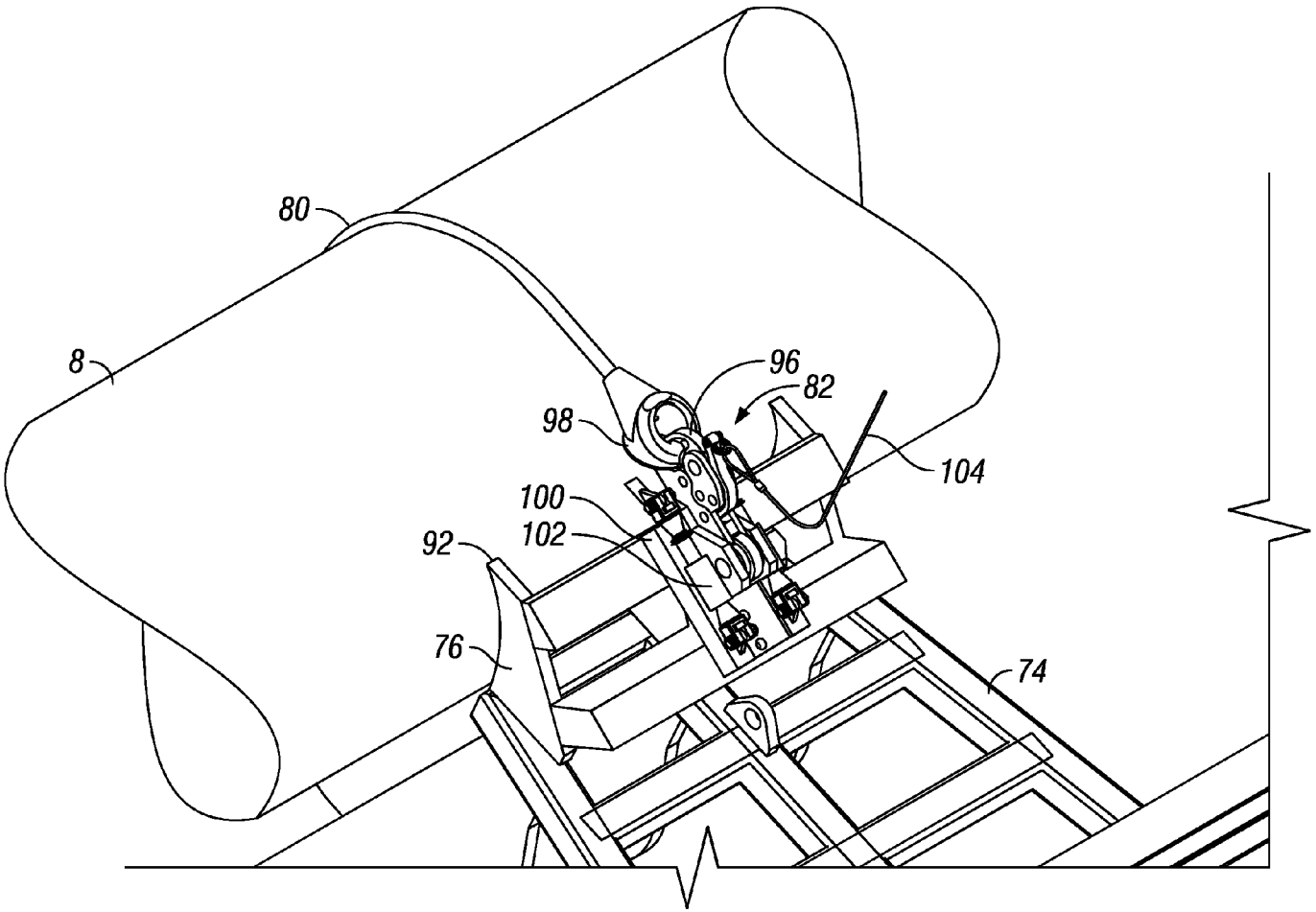
FIG. 5A is a schematic perspective view of a latch mechanism.
Figure 5C:
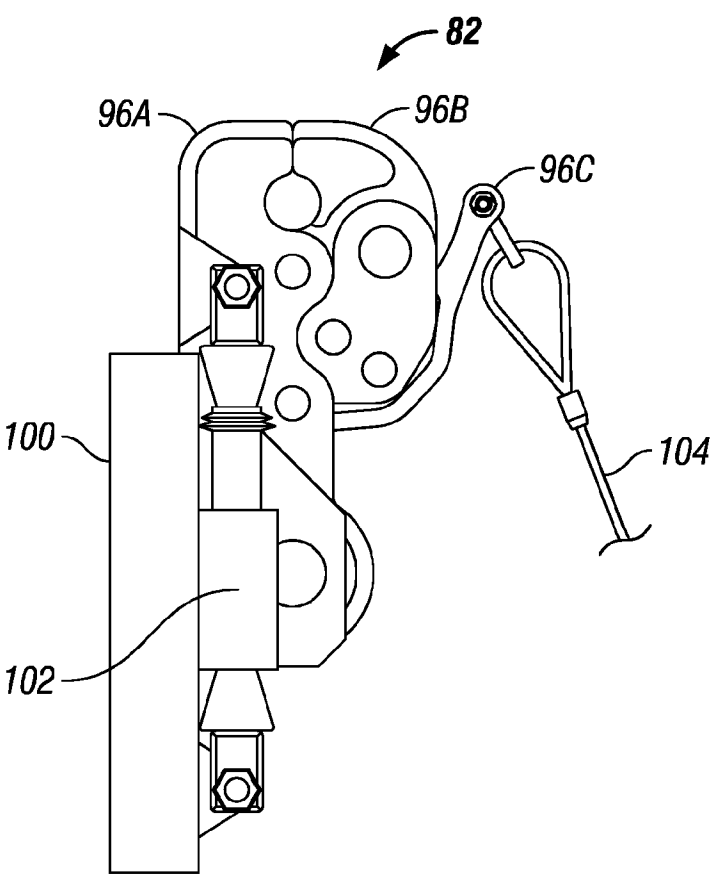
FIG. 5C is a schematic side view of the latch mechanism.
Figure 5B:
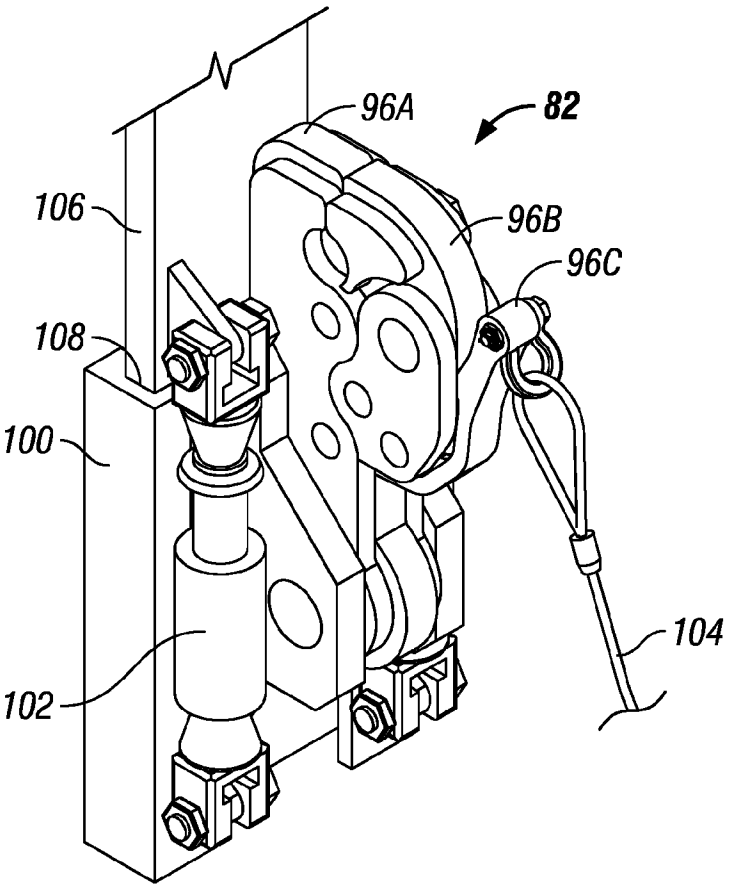
FIG. 5B is a schematic perspective view of a detail of the latch mechanism.

FIG. 5A is a schematic perspective view of a latch mechanism. FIG. 5B is a schematic perspective view of a detail of the latch mechanism. FIG. 5C is a schematic side view of the latch mechanism. The drawings will be described in conjunction with each other. When a pile 8 is disposed in a launch arm cradle 76, it is generally advantageous to tie down the pile with a tie down cable 80 coupled to the latch mechanism 82. The latch mechanism 82 can hold the tie down cable 80 and then release the cable at an appropriate time. Generally, the tie down cable 80 can be looped over an exterior perimeter of the pile 8 and coupled to the latch mechanism 82. The latch mechanism 82 has a motive force means, such as a hydraulic cylinder 102, to pull down the latch mechanism 82, as viewed in the orientation of FIGS. 5A, 5C to tighten the tie down cable 80 around the pile 8. The latch mechanism 82 can be released by a release cable 104 that opens the latch mechanism and allows the tie down cable 80 to be released, so that the pile 8 can be released and launched. More specifically, the latch mechanism 82 has a first clamp portion 96A rotatably coupled to a second clamp portion 96B. A third clamp portion 96C can be activated to open and close the second clamp portion 96B, so that the first portion 96A and the second portion 96B are closed toward each other in a closed position and open away from each other in an open position. The third clamp portion 96A can be controlled by the release cable 104. For example, when the tie down cable 80 is in a restraining position, an eye 98 of the tie down cable can be held between the first and second clamp portions 96A, 96B in a closed position.

As described above, the launch arm cradle 76 is coupled to the rotatable frame 74 and can contain a pile disposed therein after delivery from the cart 12, described in reference to FIG. 1. When the tie down cable 80 is restrained between the first and second clamp portions 96A, 96B, the hydraulic cylinder 102 can be extended relative to a portion 106 of the launch arm frame cradle 76, so that the release frame 100 of the latch mechanism 82 is pushed downward relative to the launch arm cradle 76, thereby pulling the tie down cable 80 tight around the pile 8. For example, the hydraulic cylinder 102 can be coupled, so that when the hydraulic cylinder 102 is extended, the clamp 96 is moved downward. For stability and ease of movement, the release frame 100 can include a guide slot 108 for controlling the movement of the release frame 100 relative to the launch arm cradle portion 106.

FIGS. 6 through 13 provide further details of the above described system. The figures illustrate a method of transporting the pile to the installation site, shifting (translating) the pile to the launch arm assembly, and launching the pile into the marine environment. The below described sequence and methods are exemplary and it is to be understood that other sequences and methods, the order of steps of the sequence and method described, and various combinations can be made. Thus, the exemplary sequence and method is only illustrative.

Figure 6:
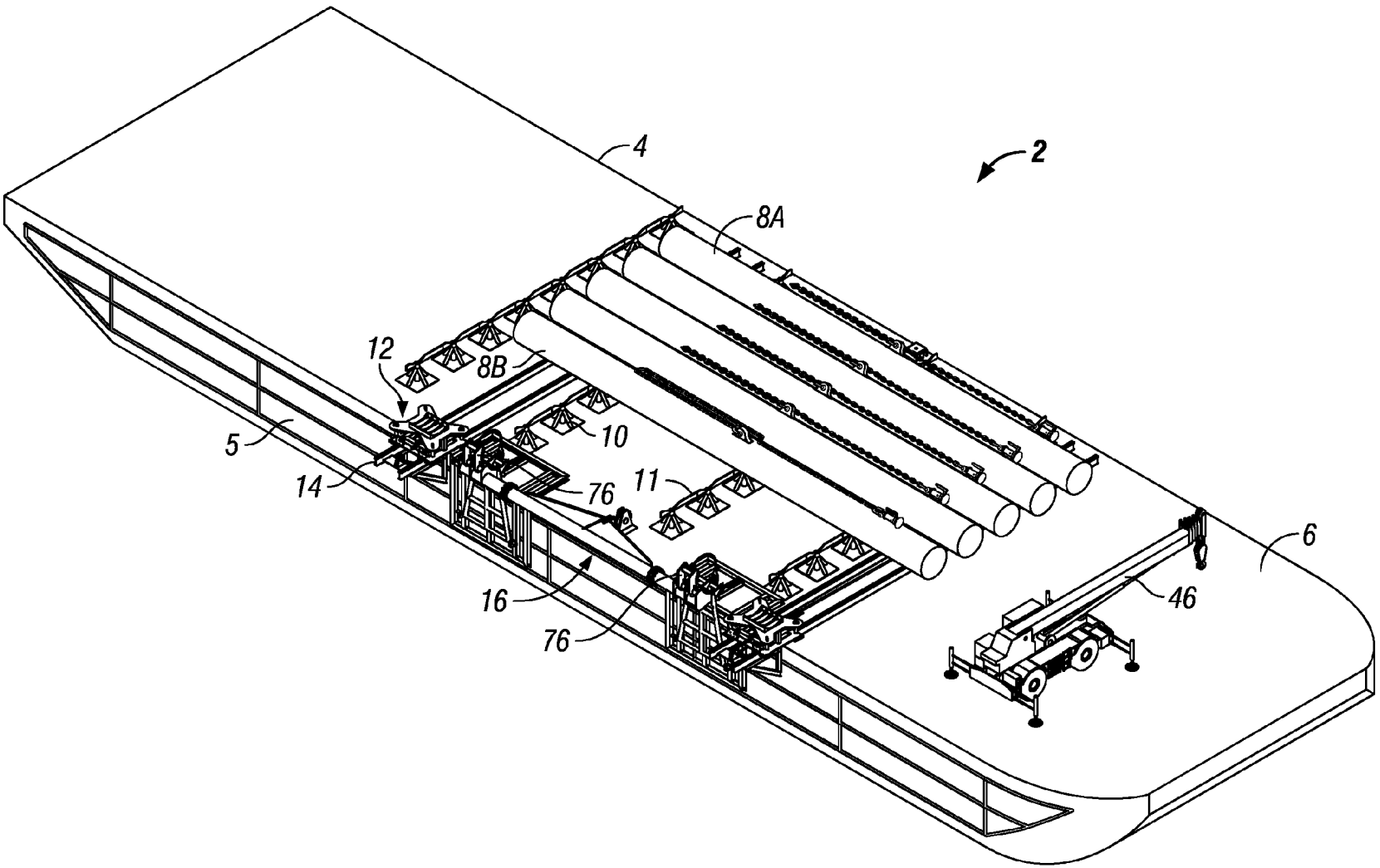
FIG. 6 is a schematic top perspective view of a vessel with the pile and system installed thereon.

FIG. 6 is a schematic top perspective view of a vessel with the pile and system installed thereon. In general, the piles are loaded onto a vessel 4 such as a barge or other floating vessel and sent, pulled, or otherwise directed to an installation site for the piles. The piles are generally stored on the rack 11 which is supported by the support 10 above the deck 6. Multiple rows of supports and racks can be used to support the piles stored thereon. The carts 12 with a travel path along the rail 14 can be placed in a stored position along the rail, such as under a pile, in proximity to a pile, or near the end of the rail, and generally in a decoupled relationship with the pile. The launch arm assembly 16 and launch arm cradle 76 are generally located close to the side 5 of the vessel 4 during transportation and before launching a pile. The crane 46 can be secured into position for performing various tasks as needed.

Figure 7A:
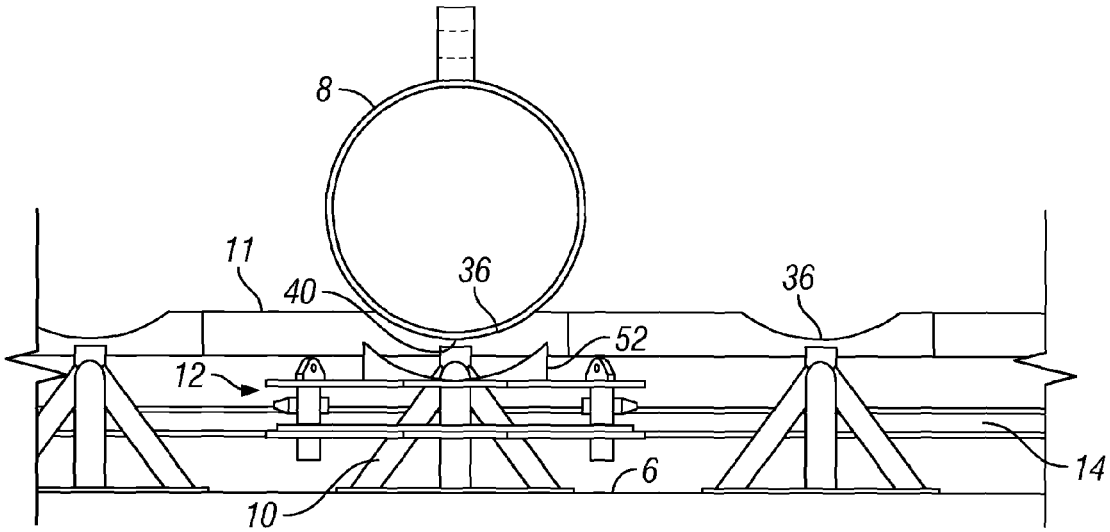
FIG. 7A is a schematic end view of a pile stored on the rack with a cart disposed thereunder.
Figure 7B:
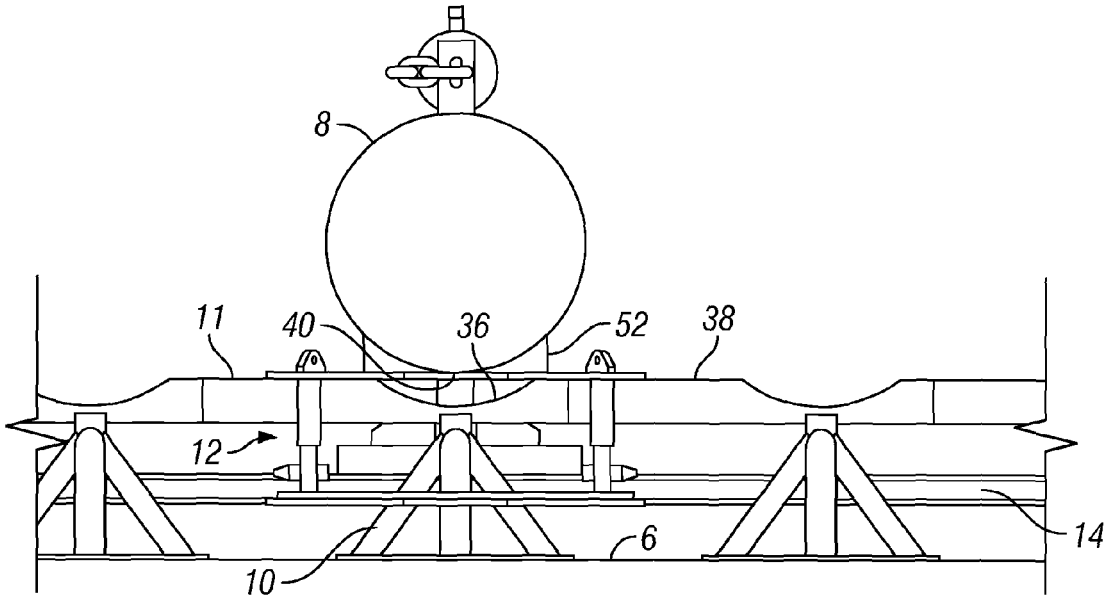
FIG. 7B is a schematic end view of the cart in a raised position lifting the pile from the rack.

FIG. 7A is a schematic end view of a pile stored on the rack with a cart disposed thereunder. FIG. 7B is a schematic end view of the cart in a raised position lifting the pile from the rack. The figures will be described in conjunction with each other. When the installation site is reached by the vessel 4, the process can begin to translate the pile 8 to a side of the vessel 4 and launch the pile into the marine environment. Generally, the piles will be located and stored in the rack slot 36 of the rack 11 coupled to the support 10 above the deck 6. The cart 12 can be shifted along the rail 14 by the motive forces, such as winches, described in reference to FIG. 1. Generally, the cart cradle 52 will have an elevation that is lower than the lower elevation 40 of the pile 8. Therefore, the cart cradle 52 can be shifted under the pile 8 without interference from the pile 8 at its lower elevation 40. The cart 12 can be activated and a motive force applied to the cart so that the cart cradle 52 rises to engage the pile 8 generally at its lower elevation 40.

With sufficient rising, the cradle 52 lifts the pile 8 from the slot 36 on the rack 11. The cart 12 continues to raise the pile 8 until at least the lower elevation 40 of the pile is higher than the rack top 38 to enable shifting of the pile over the rack 11.

Figure 8:
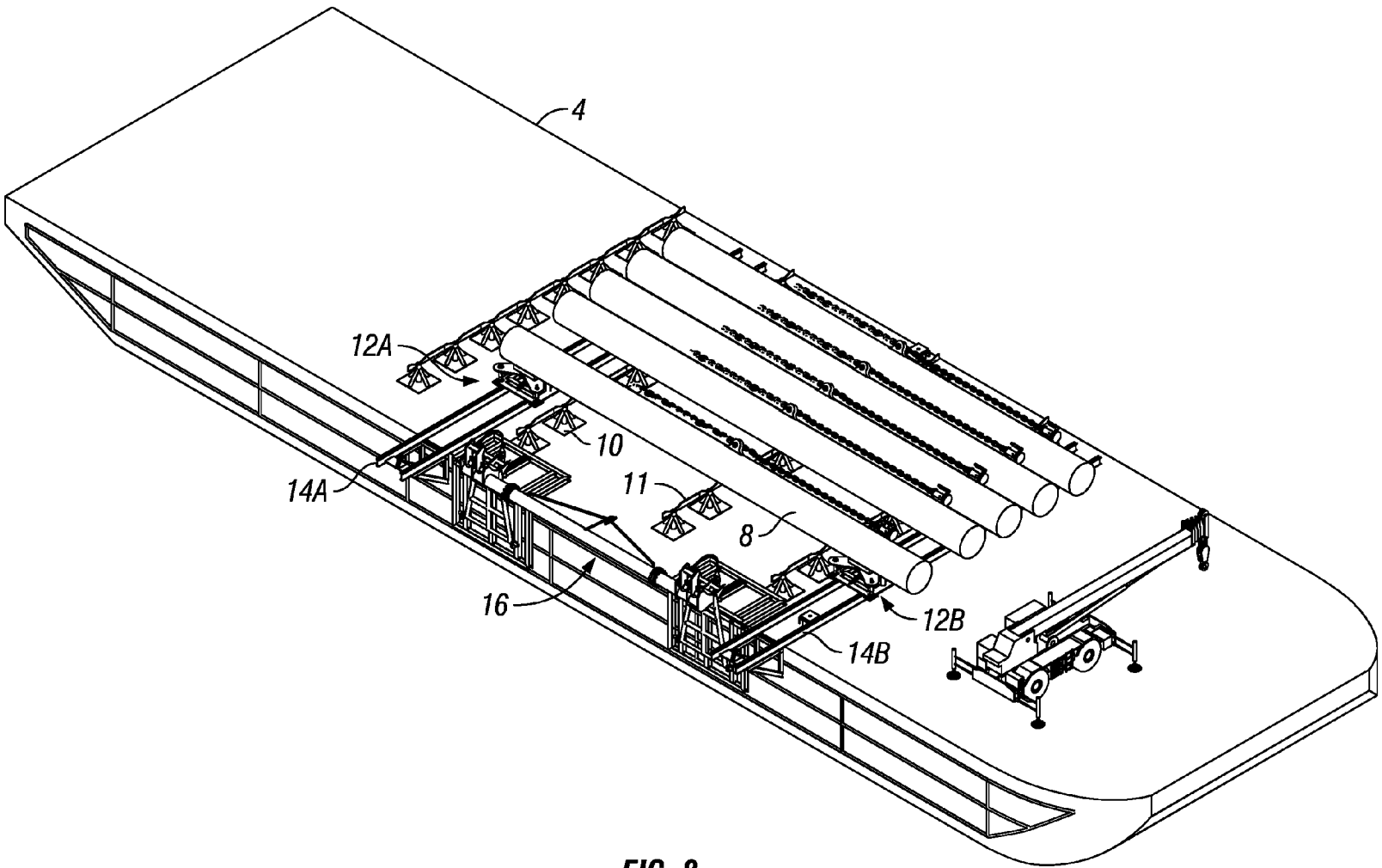
FIG. 8 is a schematic top view of the system showing the carts under the pile.

FIG. 8 is a schematic top view of the system showing the carts under the pile. The motive forces, such as the winches, can then cause the cart 12A to work in conjunction with the cart 12B along the rails 14A, 14B, so that the pile 8 is shifted toward the launch arm assembly 16. While two carts are shown, it is generally understood that any number of carts can be used as may be appropriate to the size and length of the pile 8. Because of the length of the pile relative to a dimension of the cart, it is generally expected that there will be at least be two carts, although, in some circumstances, a single cart could be used with sufficient longitudinal stability along the pile.

Figure 9A:
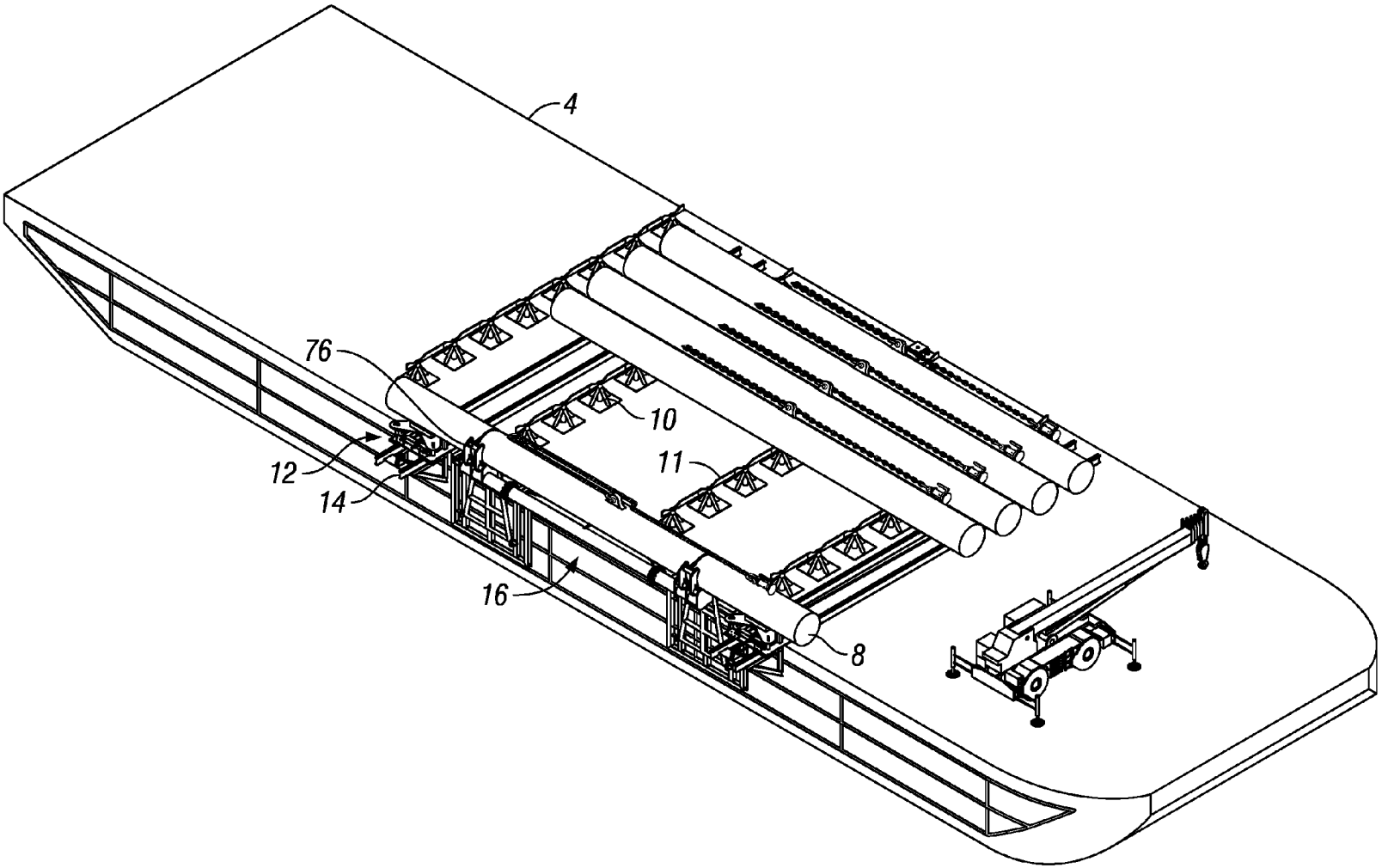
FIG. 9A is a schematic top perspective view of the cart with the pile aligned with the launch arm assembly.
Figure 9B:
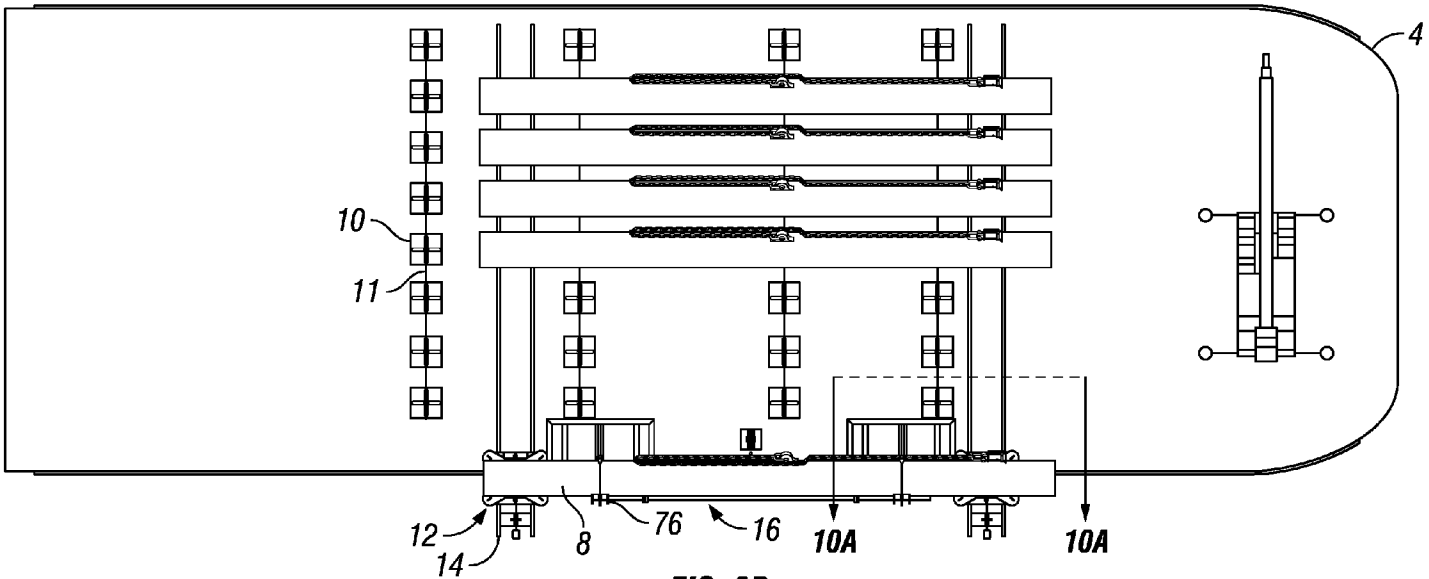
FIG. 9B is a schematic top view of the cart with the pile aligned with the launch arm assembly.

FIG. 9A is a schematic top perspective view of the cart with the pile aligned with the launch arm assembly. FIG. 9B is a schematic top view of the cart with the pile aligned with the launch arm assembly. The figures will be described in conjunction with each other. After the cart 12 has been translated toward the side 5 of the vessel 4, it can be aligned with the launch arm assembly 16 and particularly the launch arm cradle 76. In at least one embodiment, the rail 14 extends beyond the side 5 of the vessel 4 to allow sufficient travel distance of the cart 12 on the rail 14. In at least one embodiment, the launch arm assembly is located beyond from the side 5 of the vessel 4, so an extra amount of travel distance for the cart 12 along the rail 14 is useful for aligning the pile 8 on the launch arm cradle 76.

Figure 10A:
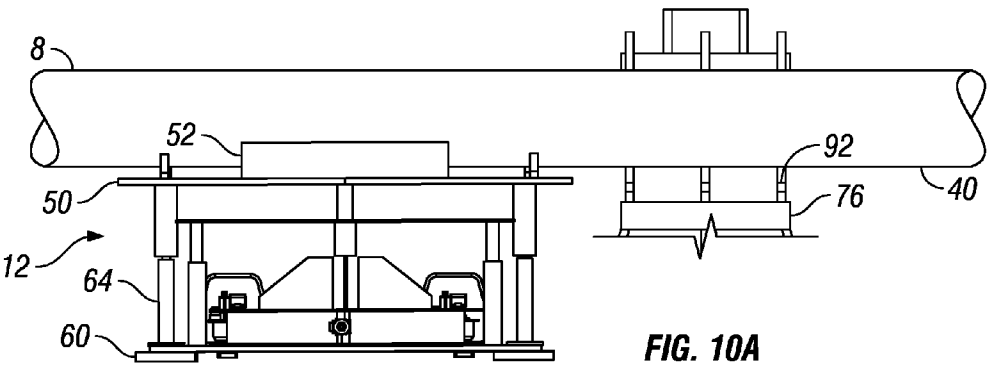
FIG. 10A is a schematic side view of the cart supporting the pile above the launch arm cradle from the orientation noted in FIG. 9B.
Figure 10B:
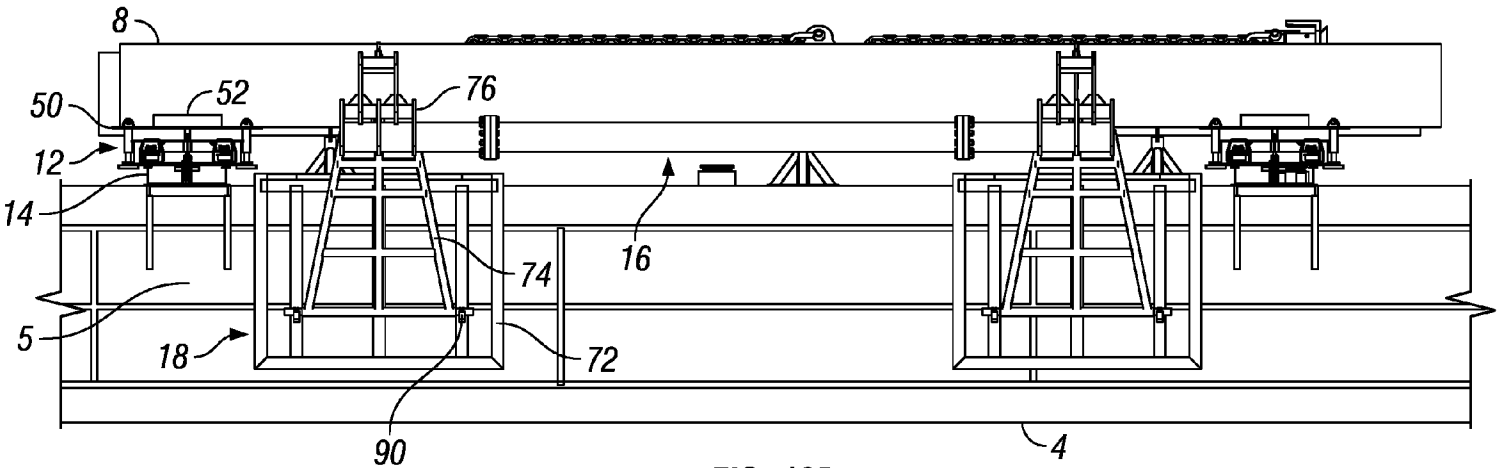
FIG. 10B is a schematic side view of the cart lowering the pile onto the launch arm cradle.
Figure 10C:
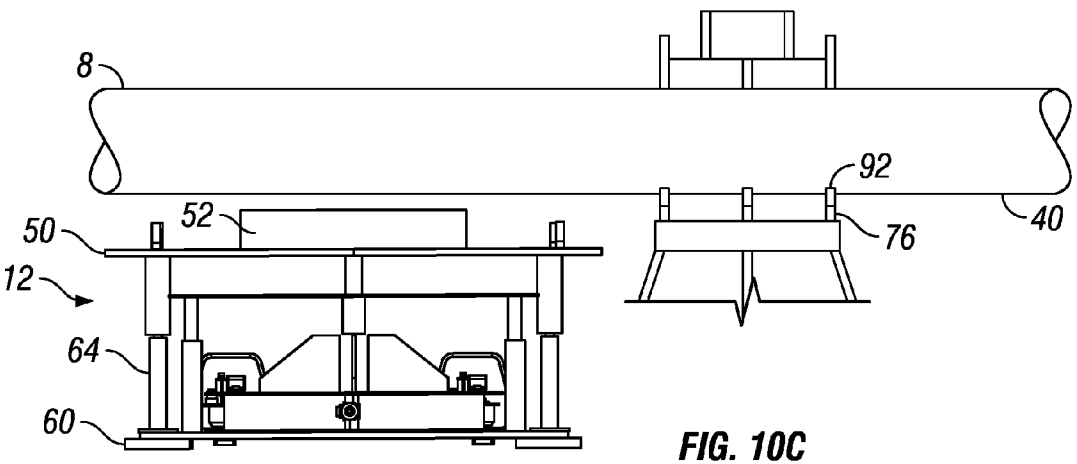
FIG. 10C is a schematic side view of the cart lowered below the pile with the pile being supported by the launch arm cradle.
Figure 10D:
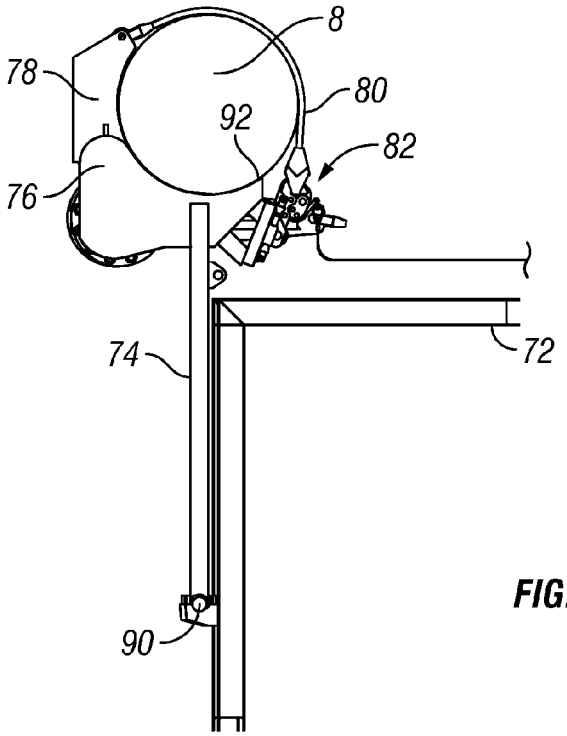
FIG. 10D is a schematic end view of the pile secured in the launch arm cradle.

FIG. 10A is a schematic side view of the cart supporting the pile above the launch arm cradle from the orientation noted in FIG. 9B. FIG. 10B is a schematic side view of the cart lowering the pile onto the launch arm cradle. FIG. 10C is a schematic side view of the cart lowered below the pile with the pile being supported by the launch arm cradle. FIG. 10D is a schematic end view of the pile secured in the launch arm cradle. The figures will be described in conjunction with each other. After the cart 12 has shifted the pile 8 along the rail 14 to be in vertical alignment with the launch arm cradle 76, the pile 8 is ready to be transferred to the launch arm cradle 76. As shown in FIG. 10A, the cart upper portion 50 is extended by the hydraulic cylinder 64 into a higher elevation above the cart lower portion 60 for shifting along the rail 14 to the launch arm cradle 76. The hydraulic cylinders 64 are extended in this mode. The cart cradle 52 supports the lower elevation 40 of the pile 8 above the launch arm cradle end 92. This elevation allows the pile to clear the entry elevations of the launch arm cradle 76, so it can be lowered into the launch arm cradle, as shown in FIG. 10B. The cart 12 can lower the cart upper portion 50 in the associated cradle 52, so that the pile 8 is lowered in elevation onto the launch arm cradle 76. The launch arm assembly 16 includes the launch frame 18 having a support frame 72 coupled to a rotatable frame 74 at one or more rotatable joints 90. The launch arm cradle 76 is coupled to the rotatable frame 74. In at least one embodiment, the rotatable frame 74 is rotated adjacent to the support frame 72, so that the launch arm assembly 16 is at a maximum elevation against the side 5 of the vessel 4. Other arrangements and elevations with various angles can be used and the embodiment is only exemplary.

FIG. 10C illustrates the lowered cart cradle 52 relative to the pile lower elevation 40 of the pile 8. The cart upper portion 50 continues to lower relative to the cart lower portion 60, and the cradle 52 becomes disengaged with the pile 8. The pile is fully supported by the launch arm cradle 76 and in the embodiment shown below the elevation of the launch arm cradle end 92 for added stability. To lower the cart upper portion 50, the hydraulic cylinders 64 retract in height so that the distance between the cart upper portion 50 and the cart lower portion 60 is reduced. Advantageously, the elevation of the top of the cart cradle 52 is below the lower elevation 40 of the pile 8. This difference in elevation allows the cart 12 to be shifted along the rail 14 back into position to move another pile, such as shown in FIG. 9.

As shown in FIG. 10D, the rotatable frame 74 is rotated in proximity to the support frame 72 at the rotatable joint 90 to obtain a maximum elevation of the launch arm cradle 76. The release arm 78 is rotated against the pile 8 and the tie down cable 80 is coupled to the latch mechanism 82 to hold the release arm 78 in position and the pile 8 to the launch arm cradle 76. The pile is now in a pre-launch position.

Figure 11:
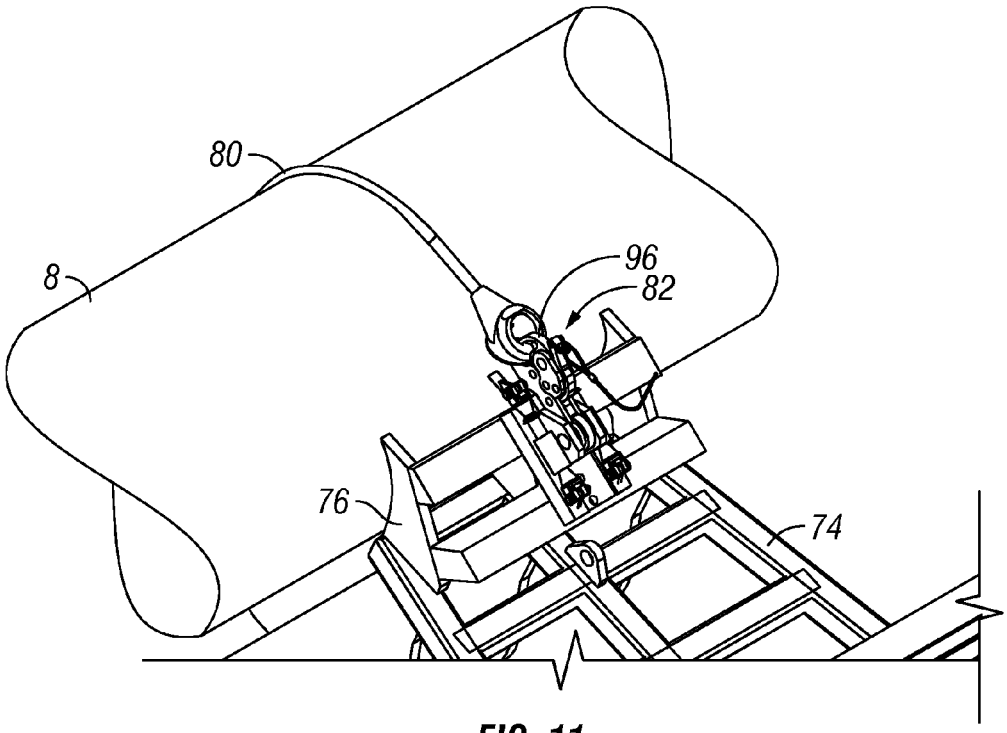
FIG. 11 is a schematic top view showing a detail of the pile secured in the launch arm cradle.

FIG. 11 is a schematic top view showing a detail of the pile secured in the launch arm cradle. After the pile 8 is delivered by the cart 12 to the launch arm cradle 76, it is generally advantageous to secure the pile 8 to the launch arm cradle 76 and the release arm 78 to the latch mechanism 82. The tie down cable 80 can be looped over the pile 8, so that the end of the tie down cable having an eye can be inserted into the clamp 96 of the latch mechanism 82. The tie down cable 80 and the associated latch mechanism 82 can help restrain the pile 8 in the launch arm assembly 76 even as the rotatable frame 74 is rotated to a lower elevation prior to launching the pile 8.

Figure 12A:
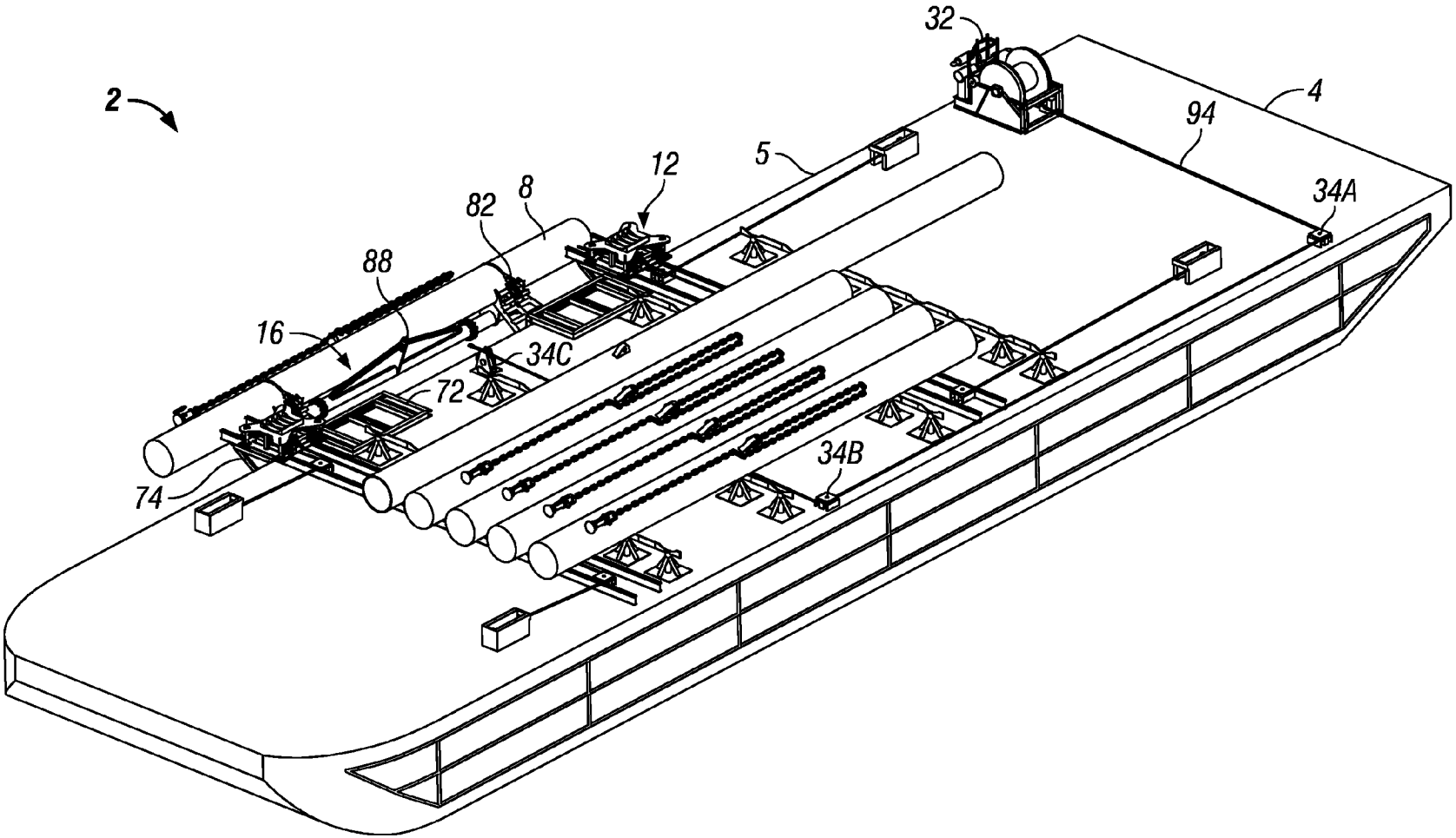
FIG. 12A is a schematic top view of the system showing a pile in a pre-launch position.
Figure 12B:
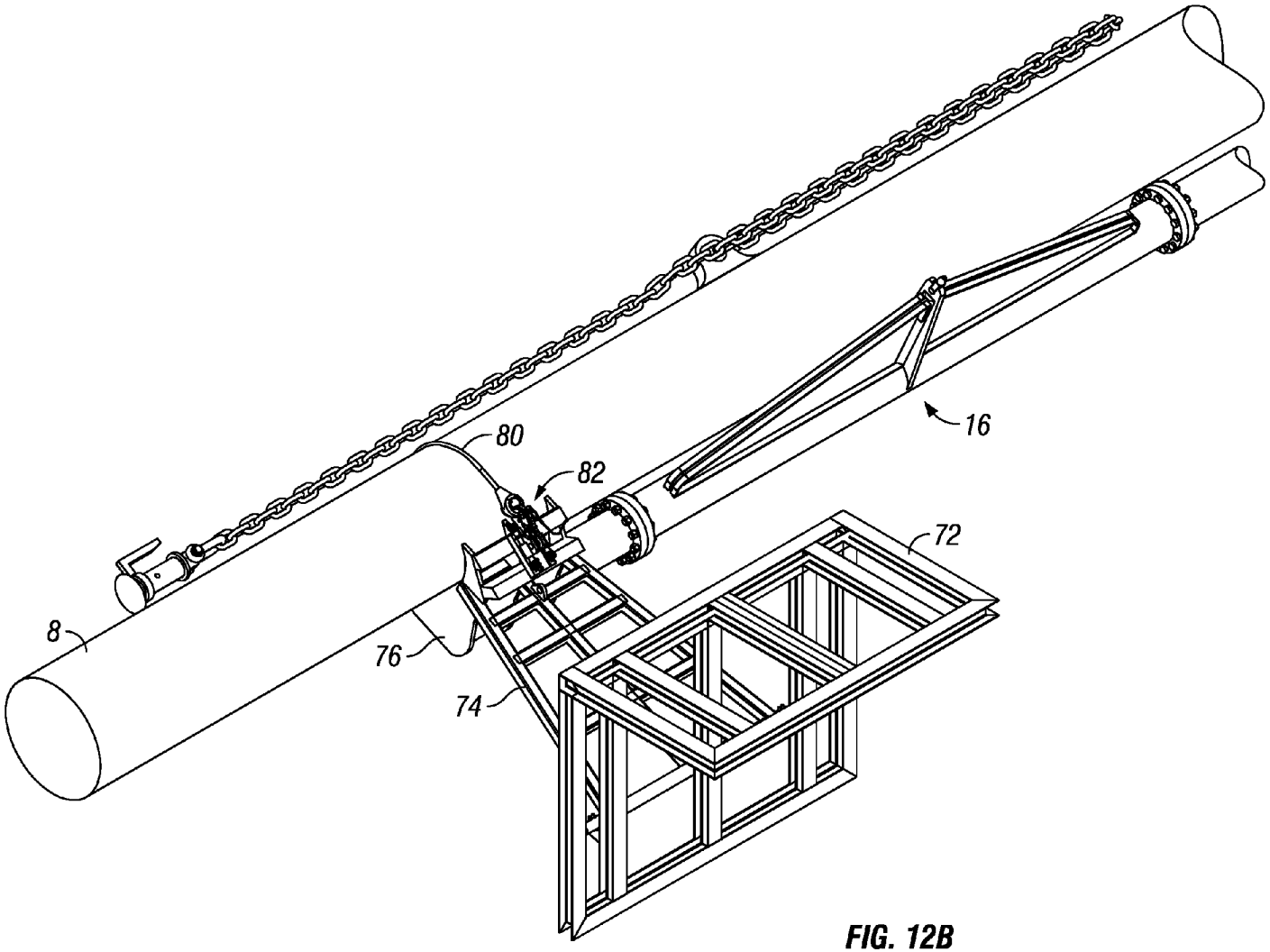
FIG. 12B is a schematic top detail view of the system in FIG. 12A.
Figure 12C:
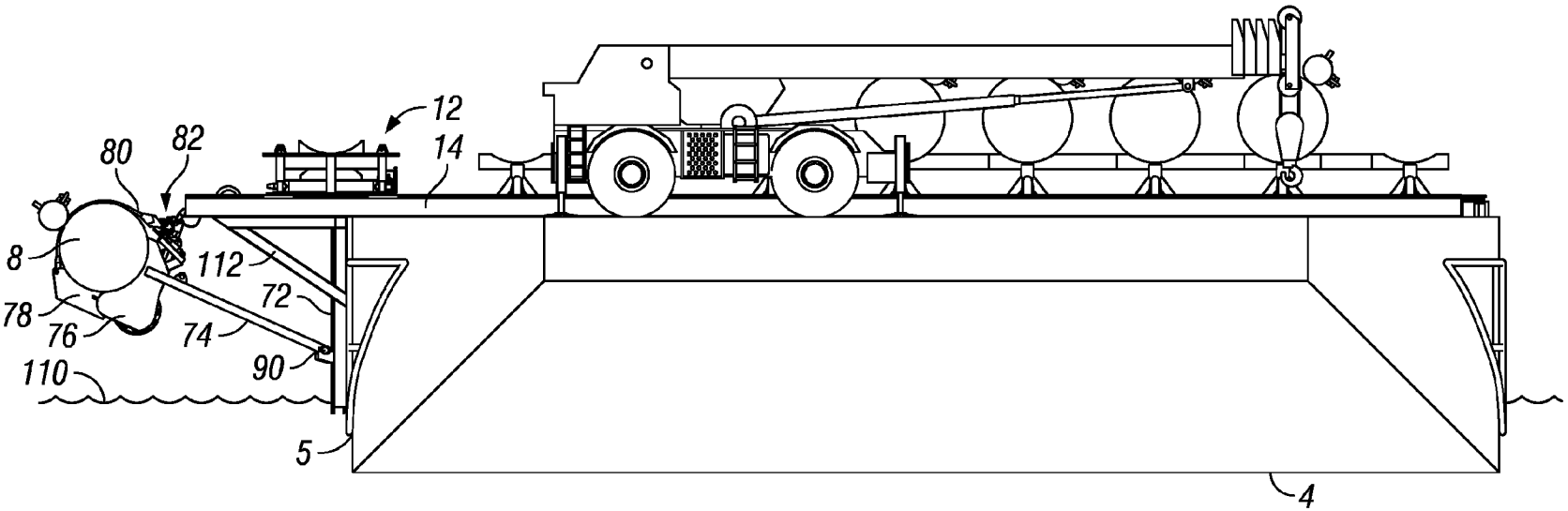
FIG. 12C is a schematic end view of the system in FIG. 12A.

FIG. 12A is a schematic top view of the system showing the pile in a pre-launch position. FIG. 12B is a schematic top detail view of the system in FIG. 12A. FIG. 12C is a schematic end view of the system in FIG. 12A. These figures will be described in conjunction with each other. After the pile 8 is secured in the launch arm cradle 76, the rotatable frame 74 can be allowed to rotate away from the vessel 4 and specifically away from the support frame 72 in the embodiment shown. The rotatable frame 74 can rotate relative to the vessel 4 for the side 5 and the support frame 72 at one or more rotatable joints 90. To allow the rotatable frame 74 of the launch arm assembly 16 to be rotated outwardly away from the side 5, the winch 32 can release an amount of the winch cable 94 to create a slack condition on the rotatable frame 74 and allow the rotatable frame to rotate outwardly. The cable 94 can be looped around the sheave 34A, around the sheave 34B, and over the sheave 34C to attach to the launch arm coupling 88 of the launch arm assembly 16. Alternatively, other motive forces could be used, such as hydraulic cylinders, gears, chain drives, and the like, that would push the rotatable frame 74 outwardly from the vessel 4. After the pile 8 is launched as described below, the winch 32 can pull back the winch cable 94 to create tension on the rotatable frame 74 and pull the frame back into position against the side 5 of the vessel 4 to receive another pile 8 from the cart 12.

As shown in FIG. 12C, the tie down cable 80 coupled to the latch mechanism 82 can maintain engagement of the pile 8 with the launch arm cradle 76 as the pile 8 is lowered with the rotatable frame 74. The rotatable frame 74 can rotate the pile 8 and associated assembly to a lower elevation in proximity to the marine environment 110. Also, as shown in FIG. 12C, the rail 14 can extend beyond the side 5 to allow the cart 12 to position the pile 8 in the launch arm cradle 76 when the launch arm cradle is adjacent to the support frame 72. To provide support for the extended rail 14, one or members forming a support frame 112 can be used to support the rail.

Figure 13:
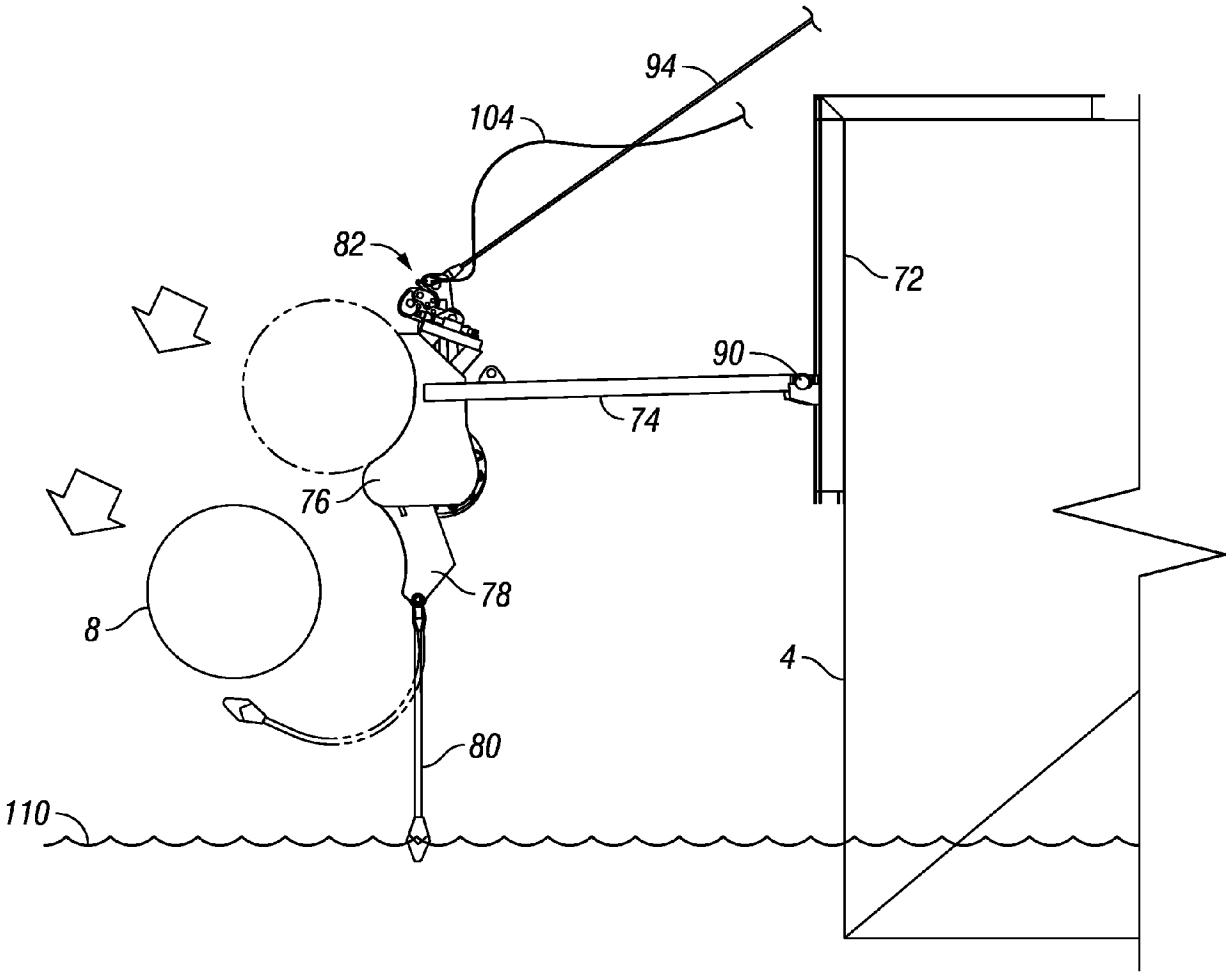
FIG. 13 is a schematic end view of the pile being launched.

FIG. 13 is a schematic end view of the pile being launched. When the rotatable frame 74 is rotated to an appropriate position relative to the vessel 4 and the support frame 72 at the rotatable joint 90, the pile can be released into the marine environment 110. In at least one embodiment, the release cable 104 can be pulled to open the latch mechanism 82 to release the tie down cable 80 from around the pile 8 and to release the release arm 78. Because of the angle and position of the launch arm cradle 76, the pile 8 can be launched into the marine environment 110 as the release arm 78 rotates away from the restrained position caused by the tie down cable 80. The pile 8 thus can be launched into the marine environment 110 and be installed in a proper position in the sea floor. It is to be understood that an end of the pile 8 would generally be coupled by a cable to another vessel (not shown) some distance away from the vessel 4. As the pile descends in the marine environment, the pile swings in an arc about the vessel coupled to the pile 8. The other vessel can position the suspended pile into the marine environment 110 at an appropriate position. The swinging motion is known in the art and explained for example in U.S. Publ. No. 20070017680. Thus, it is not described in further detail as being unnecessary to the understanding of the invention herein.

Other and further embodiments utilizing one or more aspects of the inventions described above can be devised without departing from the spirit of the invention. For example, the cables could be chains, the motive forces could be gears and sprockets, and other variations. Further, the various methods and embodiments of the translating movement that shifts the pile and launches the piles can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and may further include without limitation integrally forming one functional member with another in a unity fashion. The coupling may occur in any direction, including rotationally.

The systems and methods herein have been described in the context of various embodiments and not every embodiment has been described. Apparent modifications and alterations to the described embodiments are available to those of ordinary skill in the art. The disclosed and undisclosed embodiments are not intended to limit or restrict the scope or applicability of the concepts of the Applicants, but rather, in conformity with the patent laws, Applicants intend to protect all such modifications and improvements to the full extent that such falls within the scope or range of equivalent of the following claims.

Further, any references mentioned in the application for this patent, as well as all references listed in the information disclosure originally filed with the application, are hereby incorporated by reference in their entirety to the extent such may be deemed essential to support the enabling of the concept. However, to the extent statements might be considered inconsistent with the patenting of the concept, such statements are expressly not meant to be considered as made by the Applicant(s).

The invention claimed is:

1. A system for translating and launching a pile for a marine application, comprising:

a vessel;

at least one rack coupled to the vessel;

a first pile disposed on the rack;

at least one cart disposed on a travel path lateral to a length of the pile;

a first motive force means coupled to the cart and adapted to move the cart along the travel path;

a second motive force means coupled to the cart and adapted to raise and lower the cart between a first elevation and a second elevation, the first elevation being lower than an elevation of the pile when disposed on the rack to provide clearance for the cart as the cart moves laterally under the pile, and the second elevation being higher than a height of the rack to provide clearance for the pile as the cart laterally moves the pile over the rack;

a first portion of a launch arm assembly rotatably coupled in proximity to a side of the vessel and adapted to receive the pile during a transfer from the cart; and a third motive force means adapted to cause rotation of the first portion of the launch arm assembly between a first position adapted to receive the pile from the cart and a second position adapted to allow the pile to be launched from the first portion of the launch arm assembly.

2. The system of 1, wherein the first portion of the launch arm assembly comprises a latch mechanism adapted to secure the pile to the launch arm assembly as the launch arm assembly rotates between the first position and the second position.

3. The system of 1, wherein the first portion of the launch arm assembly has a center of gravity disposed past the side of the vessel and is adapted to rotate by weight to the second position and be pulled to the first position by the third motive force means.

4. The system of 1, wherein the rack, the cart, the first portion of the launch arm assembly, or a combination thereof comprises a cradle adapted to maintain the pile in a fixed position relative to the cradle during movement.

5. A method of translating and launching a pile for a marine application, comprising:

storing at least a first pile on at least one rack located on a vessel;

transporting the pile to an installation site with the vessel;

lifting the pile from the rack with at least one cart;

supporting the pile on the cart;

shifting the cart and the pile laterally to a launch arm assembly;

transferring the pile from the cart to a first portion of the launch arm assembly adjacent to a side of the vessel;

lowering the first portion of the launch arm assembly with the pile; and releasing the pile from the first portion of the launch arm assembly into a marine environment.

6. The method of 5, wherein lowering the first portion of the launch arm assembly and the pile comprises rotating the first portion of the launch arm assembly and the pile away from a side of the vessel.

7. The method of 5, further comprising shifting the pile laterally past the side of the vessel and transferring the pile from the cart to the first portion of the launch arm assembly beyond the side of the vessel.

8. The method of 5, wherein lifting the pile from the rack comprises raising the cart to engage the pile and wherein supporting the pile on the cart comprises supporting the pile on the cart at a higher elevation than the rack.

9. The method of 5, further comprising pulling the cart with a cable to shift the pile laterally across the vessel.

10. The method of 5, further comprising pulling the cart to a supporting position under a second pile after transferring the first pile.

11. The method of 5, further comprising holding the first portion of the launch arm assembly toward the side of the vessel prior to transferring the pile from the cart to the first portion and releasing the first portion to allow the first portion to rotate away from the side of the vessel and lower the first portion.

12. The method of 5, wherein the shifting the pile laterally to the first portion of the launch arm assembly comprises shifting the pile independent of rotating the pile on the cart as the pile and cart are shifted laterally.

* * * * *